US006266830B1

(12) United States Patent
Danno et al.

(10) Patent No.: US 6,266,830 B1
(45) Date of Patent: Jul. 31, 2001

(54) BATHING APPARATUS

(75) Inventors: Kazuhisa Danno, Otsu; Kazuaki Kira, Kobe; Hiroshi Matsumoto, Tokyo, all of (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 09/254,320

(22) PCT Filed: Jul. 6, 1998

(86) PCT No.: PCT/JP98/03043

§ 371 Date: Mar. 4, 1999

§ 102(e) Date: Mar. 4, 1999

(87) PCT Pub. No.: WO99/02117

PCT Pub. Date: Jan. 21, 1999

(30) Foreign Application Priority Data

| | | |
|---|---|---|
| Jul. 8, 1997 | (JP) | 9-182218 |
| Jan. 21, 1998 | (JP) | 10-009669 |
| Jan. 21, 1998 | (JP) | 10-009670 |
| Jan. 21, 1998 | (JP) | 10-009671 |

(51) Int. Cl.[7] ..... A47K 3/06
(52) U.S. Cl. ..... 4/585
(58) Field of Search ..... 4/585, 587, 601, 4/604; 607/86

(56) References Cited

U.S. PATENT DOCUMENTS

| | | | | |
|---|---|---|---|---|
| 4,935,971 | * | 6/1990 | Dunn et al. | 4/585 X |
| 5,106,493 | * | 4/1992 | McIntosh | 4/665 X |
| 5,647,071 | * | 7/1997 | Suzuki et al. | 4/604 X |
| 5,839,135 | * | 11/1998 | Kitamura | 4/601 X |

FOREIGN PATENT DOCUMENTS

| | | |
|---|---|---|
| 60-129641 | 8/1985 | (JP) . |
| 62-64354 | 4/1987 | (JP) . |
| 7-88146 | 4/1995 | (JP) . |

* cited by examiner

*Primary Examiner*—Charles E. Phillips
(74) *Attorney, Agent, or Firm*—Armstrong, Westerman, Hattori, McLeland & Naughton LLP

(57) ABSTRACT

A bathing apparatus related to the present invention provided with an open portion in a bag having a content volume that allows a bather to enter in addition to being provided with hoses which supply and discharge a bathing liquid at suitable locations of a bathing bag that is provided with open/close portions in succession from the edge of the open portion which can maintain a water tight state when the open/close portions are closed. The bathing apparatus is characterized by the bathing bag and hoses connected using joints comprised by a joint portion disposed in one direction being linkable to a joint portion disposed in another direction which form a water passing state when linked together and when not linked together at least one of the joints being in a water non-passing state.

8 Claims, 19 Drawing Sheets

BATHING APPARATUS

BACKGROUND OF THE INVENTION

1. Field of the Invention

The present invention relates to an ordinary household bathing apparatus that allows a disabled person to easily enter a bath.

2. Description of the Related Art

A conventional simple bathing bag for a disabled person, such as a bed-ridden older person, has been disclosed in unexamined utility model application publication HEI 6-61239. Namely, a bather is positioned inside this bathing bag using a closed-end bathing bag and then with the upper half of the bathers body in an inclined state, the bathing bag bathes the bather by supplying hot water from the end of a hose inserted from an open portion of the bathing bag thereafter the water discharges from the lower portion of the bathing bag through a hose inserted and positioned inside the bag. In a conventional simple bathing bag, it is necessary to insert and mount the end of the hose from the open portion of the bathing bag or the lower portion of the bathing bag. Because of this, the connection of the hose was troublesome and these was also the possibility that the operation could not be carried out well. Further, there was also another problem in which water would leak out from the end of the hose or the connection portion of the bathing bag when connecting and mounting a hose to the bathing bag.

Moreover, the conventional simple bathing bag disclosed in unexamined utility model application publication HEI 6-61239 naturally discharges water from the lower portion of the bathing bag after bathing is complete. Therefore, there was a fault in which time was required for the water to discharge making it impossible to completely discharge all the water inside the bathing bag. In addition, even if a pump was used to discharge the water, there was a problem of indentations which can occur on beds or futons where the bathtub is set at locations where the weight bearing buttocks portion of the bather are located thereby making it easy for hot water to collect. Hot water gathering in an indentation in this manner had to be scooped out using a small vessel or wiped up using many towels.

Even further, in order to wash the body of a bather, the conventional simple bathing bag disclosed in unexamined utility model application publication HEI 6-61239 had to discharge water from the lower portion of the bathing bag using a hose after supplying hot water an open portion of the bathing bag by pumping up water from a bathtub using a submerged pump. However, there was a fault in which too much time was required to discharge the water by only letting the water discharge naturally. If an discharge pump was newly used, two pumps would be necessary thereby increasing the complexity of operations as well as increasing costs. Further, when discharging hot water used to wash and rinse the body of a bather and then supply clean hot water, thee were problems in which too much time was required to discharge the water naturally making a large amount of hot water necessary. And, if two pumps were used, adjusting the amount of hot water was difficult and overflows occurred.

The conventional simple bathing bag disclosed in unexamined utility model application publication HEI 6-61239 had another problem in which if hot water was supplied to the inside of a bathing bag in a state wherein a bather was positioned inside a closed-end bathing bag with the upper half of the bathers body in an inclined state, the bathing bag would expand laterally due to the soft material of the bathing bag closing in on the body of the bather from the top and the bottom giving the bather an uncomfortable feeling of tightness. Moreover, it is also possible to manufacture a bathing bag using hard materials although for this case, a new problem surfaced in which it became difficult to position the bather inside the bathing bag.

Thereupon, the present invention provides a bathing apparatus that allows a simple connection between a bathing bag and hoses and in addition, even when connecting hoses to and removing hoses from the bathing bag, it is possible to completely remove bathing liquid remaining after discharging liquid from inside a bathing bag after bathing is complete without water inside the bathing bag or hoses overflowing allowing the body of a bather to be washed. Furthermore, a low-cost bathing apparatus can be provided with simple operations that prevents the bathing bag from expanding laterally while bathing making it possible for a bather to experience comfortable bathing without feeling a sense of incompatibility with the bathtub.

SUMMARY OF THE INVENTION

The bathing apparatus of the present invention is comprised by an open portion in a bag having a content volume that allows a bather to enter, hoses which supply and discharge a bathing liquid at suitable locations of a bathing bag that is provided with open/close portions in succession from the edge of said open portion which can maintain a water tight state when the open/close portions are closed. The bathing apparatus is characterized by the bathing bag and the hoses connected using joints comprised by a joint portion disposed in one direction being linkable to a joint portion disposed in another direction which form a water passing state when linked together and when not linked together at least one of the joints being in a water non-passing state.

In the bathing apparatus of the present invention, there is no overflowing water and contamination even if hoses to supply and discharge bathing liquid are installed.

The bathing apparatus above can further use a joint that sets both joints in a water non-passing state when not linked.

The bathing apparatus further comprises a shower nozzle having a linkable joint disposed at a joint mounted to a hose end that supplies bathing liquid to the inside of the bathing bag.

In the bathing apparatus above, a shower nozzle can be easily used.

The bathing apparatus with a shower nozzle is further provided with a hair washing portion positioned at the head of a bather.

In the bathing apparatus above, the hair of a bather can be easily washed.

The bathing apparatus above can be provided with a spray washing portion inside the bathing bag with the spray washing portion being hollow and having one or more holes drilled on its surface.

In the bathing apparatus the body of a bather can be delicately washed.

The bathing apparatus of the present invention is comprised by an open portion in a bag having a content volume that allows a bather to enter, hoses which supply and discharge a bathing liquid at suitable locations of a bathing bag that is provided with open/close portions in succession from the edge of the open portion which can maintain a water tight state when the open/close portions are closed. The bathing apparatus is further characterized by being provided with a suction nozzle that discharges water by means of sucking out remaining liquid after discharging the bathing liquid inside the bathing bag.

In the bathing apparatus with the suction nozzle, bathing liquid can be completely removed using the suction nozzle.

The bathing apparatus above allows the base of the suction nozzle to be connected to the end of a discharge hose having a discharge pump that discharges bathing liquid from the inside of the bathing bag.

In the bathing apparatus with the suction nozzle a discharge pump can be used increasing efficiency making the apparatus economical.

The bathing apparatus above uses joints wherein a joint portion disposed in one direction can be linked to a joint portion disposed in another direction forming a water passing state when linked together and when not linked together at least one of the joints being in a water non-passing state as well as being provided with a joint linkable to a joint of the discharge hose and the base of the suction nozzle together with the bathing bag being connected to the discharge hose.

The bathing apparatus of above further has a discharge pump which is a self-priming type.

In the bathing apparatus with the self-priming discharge pump water can be reliably discharged.

The bathing apparatus above has an impeller rotated by a motor internally disposed inside the nozzle portion of the suction nozzle that functions as a centrifugal pump on the nozzle portion itself.

In the bathing apparatus of the present invention, bathing liquid can be completely removed.

The bathing apparatus of the second embodiment is comprised by an open portion in a bag having a content volume that allows a bather to enter, a bathing bag provided with open/close portions in succession from the edge of the open portion which can maintain a water tight state when the open/close portions are closed, and a pump. The bathing apparatus is further characterized by the ends of two hoses connecting to suitable locations of the bathing bag and the base of these hoses connecting to an outlet of the pump forming a suction side hose and a discharge side hose. Moreover, the bathing apparatus is further provided with a switching valve of the flow path that branches a water supply hose that functions to supply bathing liquid from the suction side hose and in addition another switching valve of the flow path is also provided that branches a water discharge hose that functions to discharge bathing liquid from the discharge side hose.

In the bathing apparatus of the second embodiment, it is possible to easily and economically supply, circulate and discharge water by only using one pump and switching a switching valve.

The bathing apparatus of the second embodiment can further provide a three-way valve is used as the switching valve.

In the bathing apparatus above the switching valve can be an electromagnetic valve.

The bathing apparatus of the second embodiment can further have a pump which is a self-priming type.

The bathing apparatus above can further be provided with a filter within the suction side hose or on a water discharge outlet inside the bathing bag.

In the bathing apparatus above, foreign material occurring while bathing can be removed preventing foreign material from clogging the pump or hoses and damaging the apparatus.

The bathing apparatus of the second embodiment has a water processing device that either reduces bacteria of the bathing liquid supplied to the inside of the bathing bag or converts the bathing liquid to functional water.

In the bathing apparatus above, bather's body can be efficiently washed.

The bathing apparatus of the second embodiment further uses hoses having two flow paths as the connected hoses.

In the bathing apparatus above, the bathing apparatus can be simply assembled.

The bathing apparatus of the second embodiment can have the water supply hose and the water discharge hose which are linked by a three-way coupling.

In the bathing apparatus above, the bathing apparatus can be simply assembled.

The bathing apparatus of another embodiment is comprised by an open portion in a bag having a content volume that allows a bather to enter, a bathing bag provided with open/close portions in succession from the edge of the open portion which can maintain a water tight state when the open/close portions are closed, and a pair of side support bodies located between the bathing bag and the outer surface of the bathing apparatus and the bathing bag and the inner surface of the bathing apparatus where a bather is positioned between these side support bodies.

In the bathing apparatus with a pair of support bodies, the bathing bag is prevented from expanding laterally making it possible for a bather to comfortably take a bath.

The bathing apparatus is further provided with a back support body that supports the head of a bather enclosed by the bathing bag.

The bathing apparatus above can further use an air bag in the support body.

In the bathing apparatus of this embodiment, the cushioning is excellent making it possible for a bather to take a comfortable and enjoyable bath.

The bathing apparatus with the pair of support bodies can further have the support secured to the bathing bag using adhesive.

In the bathing apparatus above, the manufacture of the apparatus can be simply done.

The bathing apparatus of a further embodiment comprises an open portion in a bag having a content volume that allows a bather to enter, a bathing bag provided with open/close portions in succession from the edge of the open portion which can maintain a water tight state when the open/close portions are closed, a support body with an approximate U-shape disposed away from both ends of the back support body that supports the head of a bather enclosed by the bathing bag and is parallel to the side support bodies where a bather is positioned between these side support bodies.

The bathing apparatus above can further have the support body formed by an air bag and set at an dimensional relation to allow the distance between the side support bodies to hold and grip a bather enclosed by the bathing bag.

In the bathing apparatus of the present invention, there is no shifting during use allowing a bather enclosed by the bathing bag to firmly secured.

The bathing apparatus of the present invention is provided with an open portion support that is formed by an air bag along an open portion in a bag having a content volume that allows a bather to enter as well as along an open portion of the bathing bag provided with open/close portions in succession from the edge of the open portion which can maintain a water tight state when the open/close portions are closed.

In the bathing apparatus above, bathing liquid can be prevented from leaking out.

The bathing apparatus above is further provided with a pair of side support bodies which are formed by air bags on both side surfaces of the bathing bag.

The bathing apparatus of a further embodiment is comprised by an open portion in a bag having a content volume that allows a bather to enter, a bathing bag provided with open/close portions in succession from the edge of the open portion which can maintain a water tight state when the open/close portions are closed, a support body used by an air mat designed to make the head portion increase in height.

In the bathing apparatus of the present invention, the apparatus can be used without bathing liquid inside the bathing bag leaking out even if a bather moves slightly.

BRIEF DESCRIPTION OF THE DRAWINGS

FIG. 13(*b*) is a conceptual view showing circulation of a bathing apparatus;

FIG. 13(*c*) is a conceptual view showing water discharge of a bathing apparatus;

FIG. 17(*b*) is a magnified cross section of another hose;

FIG. 20(*b*) is a top view showing a usage state of the supports of the first embodiment;

FIG. 23(*b*) is a top view showing a usage state of the supports of the fourth embodiment;

FIG. 24(*b*) is a top view showing a usage state of the supports of the fifth embodiment;

DESCRIPTION OF THE PREFERRED EMBODIMENTS

In the following, a bathing apparatus of the present invention will be described with reference to the attached drawings.

Figure 1:
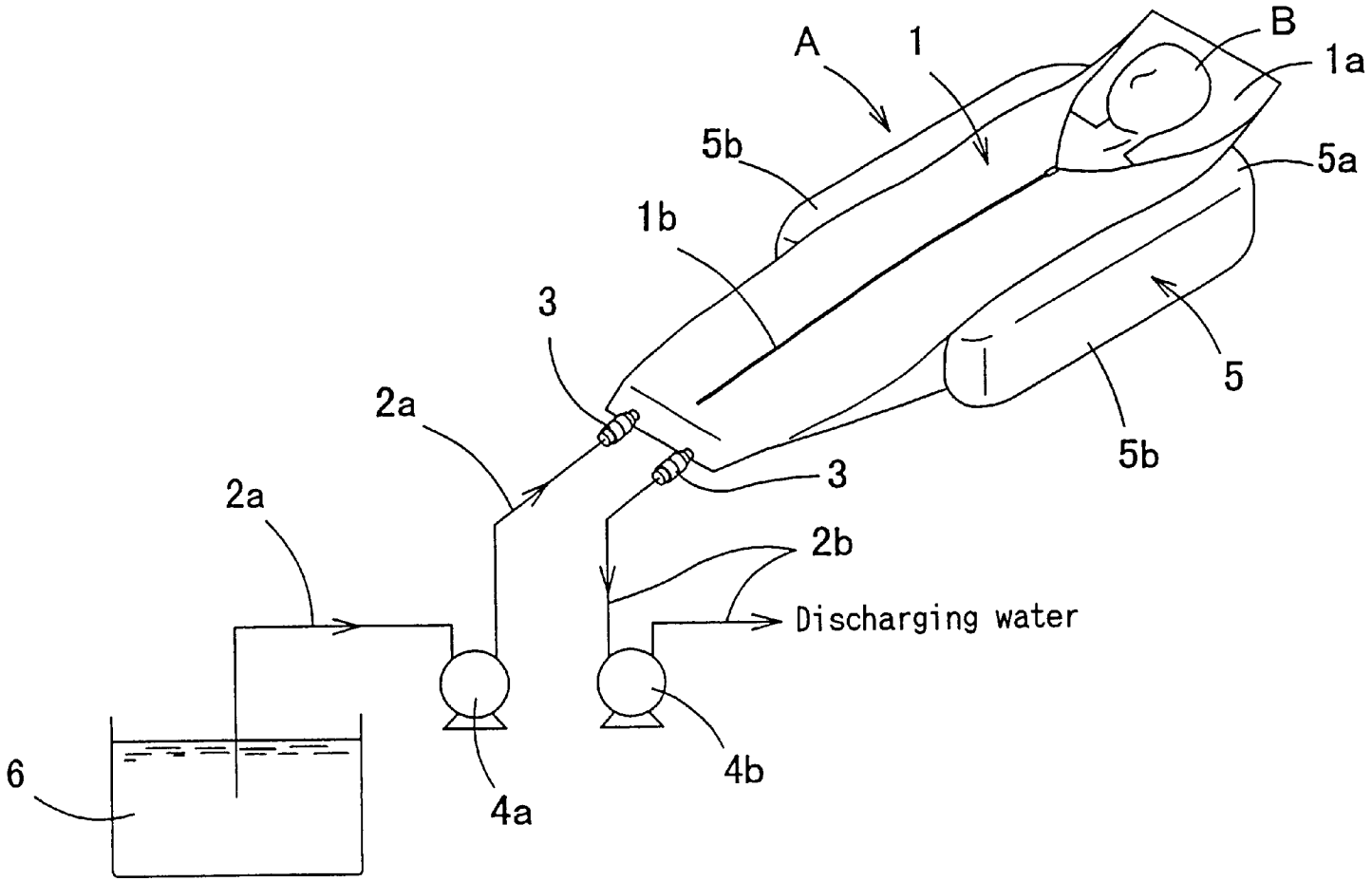
FIG. 1 is an explanatory view showing a usage state of the bathing apparatus of the first embodiment.

FIG. 1 is an explanatory view showing a usage state of the bathing apparatus of the first embodiment. As shown in FIG. 1, bathing apparatus A is comprised by bathing bag 1, hoses 2*a*, 2*b*, joint 3 that connects bathing bag 1 to hoses 2*a*, 2*b*, water supply pump 4*a*, water discharge pump 4*b* and support body 5. The bathing apparatus uses hot water of bathtub 6 to implement bathing.

To start, as shown in FIG. 1, bathing bag 1 is a bag body comprising a front surface sheet and a rear surface sheet and is created by the ends of a rectangular sheet (in a plane view) being narrowed, a pair of synthetic resin sheets overlapping to form a trapezoid shape, thermally fusing the outer edges of both sheets leaving behind the upper border to form a seal portion. Bathing bag 1 is provided with an open portion 1*a* that opens the upper edge of the front surface sheet in an approximate half ellipse and a fastener that uses an open/close portion 1*b* extending from the approximate center of the open edge of open portion 1*a* on the front surface sheet until feet of the bather extending in the lengthwise direction facing downward that allows a watertight state to be maintained when the open/close portion is closed. Bathing bag 1 is further provided with two joints 3, 3 on the lower edge of the bag body.

In particular, the example of bathing bag 1 in the figure as shown in FIG. 1 is provided with open/close portion 1*b* at the approximate center of the front surface sheet of the bag body and sets the length of this open/close portion 1*b* to a length that at least allows bather B to easily enter the bag in a prone posture. In addition, the size of the open portion formed by open portion open/close portion 1*b* is set to a size that allows bather B to be enclosed by the bag from at least the feet to the neck.

Moreover, bathing bag 1 shown in the figure is set in a shape in which the lower portion of the bag body narrows in order to reduce the amount of bathing liquid. However, the bag body can have a uniform width with a rectangular shape or can adopt a shape that swells open along a direction facing the lower portion and upper portion. Bathing bag 1 can also use a bag body produced from one sheet or a bag-shaped sheet.

As shown in FIG. 1, support body 5 utilizes an approximate U-shape comprising back support 5*a* that supports the head, neck or back of bather B, and side support bodies 5*b*, 5*b* which grip both sides of bather B. With support body 5 placed on the floor and bather B located inside bathing bag 1, the head of bather B is fit into back support 5*a* of support body 5 together with the body of bather B being positioned between both side support bodies 5*b*, 5*b* to be held tightly or have a slight gap and the neck of bather B is supported in a diagonally upward leaning state. In particular, the example of support body 5 in the figure uses a synthetic resin sheet such as a vinyl chloride resin and is formed by a bag body to unify back support 5*a* and side support bodies 5*b*, 5*b* into one unit enclosing air inside the bag producing an air bag.

Moreover, although support body 5 is used in the example above, a pillow or an inclined bed can be used in place of a support body.

As shown in FIG. 1, bathing apparatus A links water supply hose 2*a* and water discharge hose 2*b* to the lower portion of bathing bag 1 through joints 3 and provides water supply pump 4*a* in the path of water supply hose 2*a*. In addition, the end of the hose is positioned inside bathtub 6 and water discharge pump 4*b* is provided in the path of water discharge hose 2*b* as well as the end of the hose being positioned at water discharge open portion.

Water supply pump 4*a* and water discharge pump 4*b* use self-priming pumps. In detail, they are impeller type pumps which means they do not generate cavitation when water reaches the pump one time and more precisely, approximately half of the pump can fill with water and the pumps will automatically discharge air even if they are sucking in air during operation. Furthermore, a submerged pump can be used for water supply pump 4*a*. Even further, water supply pump 4*a* and water discharge pump 4*b* can be provided with a switching three-way valve in water supply hose 2*a* and water discharge hose 2*b* as one pump.

Figure 2:
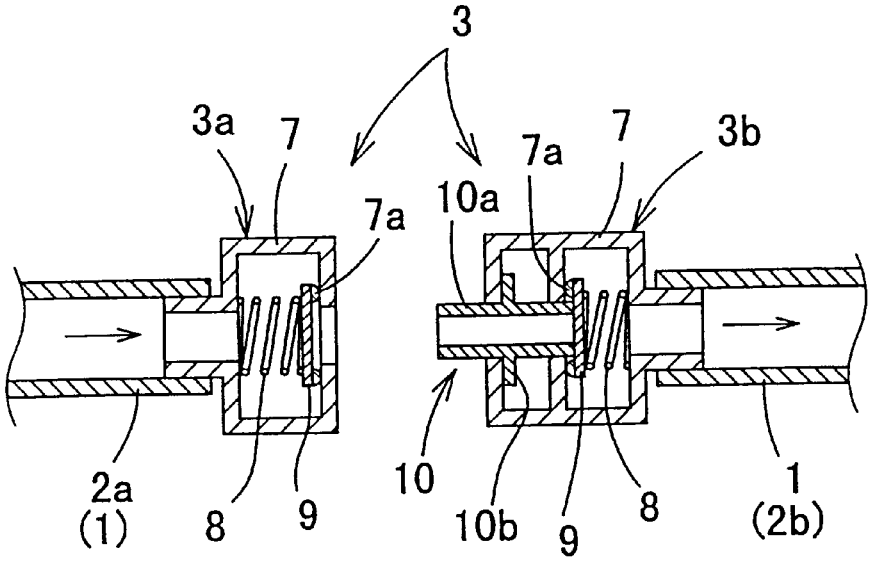
FIG. 2 is a disassembled cross section of a joint.

As shown in FIG. 2, joint 3 is a detachable joint wherein one joint portion 3*b* inserts into or screws into another joint portion 3*a*. Further, because joint portions 3*a*, 3*b* form a pair, 3*a*, 3*b* can be read as 3*b*, 3*a* in the specifications. Joint portion 3*a* is joint designed to be elastic using elastic material 8 in order that elastic material 8 (using a coil spring or a plate spring) and valve body 9 internally housed in valve main body 7 that opens to the left and right support a throughhole on the right side in a closed state using valve main body 7 interpositioned between packing 7*a*. The other joint portion 3*b* is also a joint designed to be elastic using elastic material 8 in order that elastic material 8 (using a coil spring) and valve body 9 internally housed in valve main body 7 that opens to the left and right support a throughhole on the right side in a closed state using valve main body 7 interpositioned between packing 7*a*. Then, when joint portion 3*b* is secured by insertion to joint portion 3*a* with linking socket 10 having ??linking edge?? 10*b* at the approximate center of cylinder body 10*a* that opens to the left and right in a state interpositioned between joint portion 3*a* and joint portion 3*b*, cylinder body 10*a* of linking socket 10 is inserted inside the throughhole of joint portion 3*a* and joint portion 3*b* and valve body 9 is pressed into the inside support bodying either of the joints 3*a*, 3*b* in an open state.

Moreover, if the contact portion between both ends of cylinder body 10*a* and valve body 9 has a composition that allows water to pass when making contact, there is no particular limitation on the composition. For example, there can be holes to pass water on the cylinder walls of both ends of cylinder body 10*a* and the contact portion of both ends or valve body 9 can have an uneven composition. These compositions are identical in FIG. 3 and FIG. 4.

As shown in FIG. 2, in bathing apparatus A of the example in the figure, joint portion 3*a* or joint portion 3*b* are mounted to the lower portion of bathing bag 1 and joint portion 3*a* or joint portion 3*b* are mounted to the ends of water supply hose 2*a* and water discharge hose 2*b*.

Even further, joint 3 of the example in the figure shows a type of joint incorporated inside joint portion 3*b*. However, the joint type can be one that allows linking socket 10 to be removed.

Figure 3:
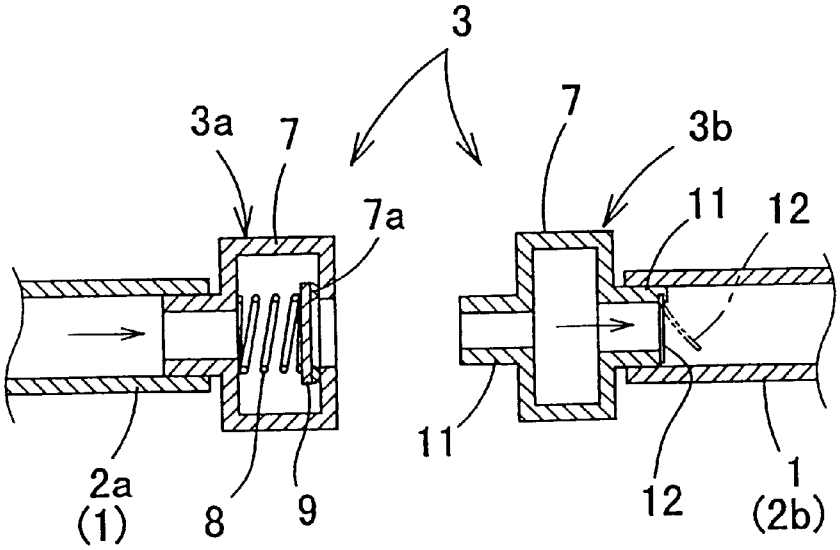
FIG. 3 is a disassembled cross section of another joint.

Furthermore, FIG. 3 is a disassembled cross section of another joint. In joint 3, joint portion 3*a* is used for joint portion 3*b* in like manner to FIG. 2. However, as shown in FIG. 3, cylinder body 11 protrudes from both sides of valve main body 7 and the left side of cylinder body 11 is made to be insertable into the throughhole of joint portion 3*a*. Soft sheet 12 (such as rubber or synthetic resin) covers the open portion of the right side of cylinder body 11 and the soft sheet is mounted to the top edge to open in the direction indicated by the imaginary line in FIG. 3 to water can only flow in the direction of the arrow.

Moreover, in joint 3 shown in FIG. 2 and FIG. 3, if joint portion 3*b* is removed from joint portion 3*a*, either joint portion 3*a* or 3*b* will be maintained in a water non-passing state. However, joint portion 3*a* need not incorporate elastic material 8 or valve body 9 nor be maintained in a water non-passing state because of joint portion 3*b* connected to hoses 2*a*, 2*b* or according to the circumstances.

Figure 4:
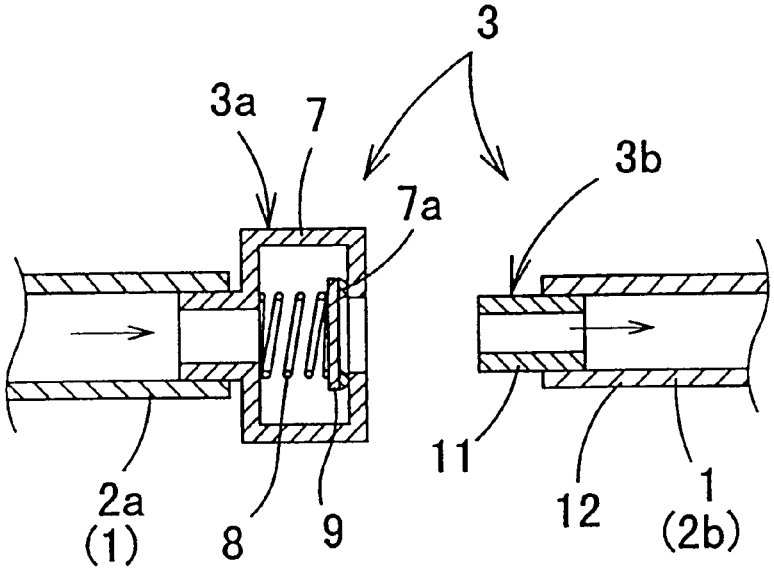
FIG. 4 is a disassembled cross section of another joint.

For example, in joint 3 shown in FIG. 4, joint portion 3*b* comprises cylinder body 11 that opens to the left and right in contrast to joint portion 3*a*. For this case, when the joints are linked, a water passing state is formed and when not linked, only joint portion 3*a* is in a water non-passing state and joint portion 3*b* is not in a water non-passing state.

Even further, if joint 3 has a composition wherein when joint portion 3*a* and joint portion 3*b* are linked, a water passing state forms and when not linked, at least one of either joint portion 3*a* or joint portion 3*b* form a water non-passing state, either of the compositions can be used.

Figure 5:
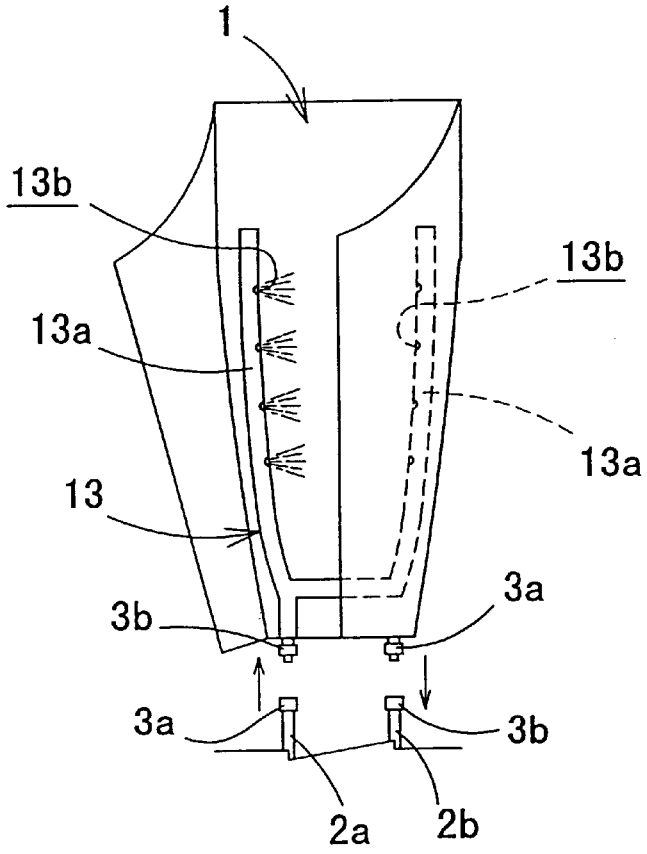
FIG. 5 is a top view showing a state in which the bathing bag is opened.

FIG. 5 is an explanatory view of an embodiment provided with spray washing portion 13 inside bathing bag 1. Spray washing portion 13 has spray holes 13*b* formed at fixed intervals on pipe 13*a* that is formed from a synthetic resin or stainless steel. As shown in FIG. 5, spray washing portion 13 of the example in the figure has two legs from the middle of the base of pipe 13*a* positioned on both sides inside bathing bag 1 and a plurality of spray holes 13*b* drilled on the inside of pipe 13*a* which spray liquid toward a bather. And even further, joint portion 3*a* links to the base of pipe 13*a*.

Figure 6:
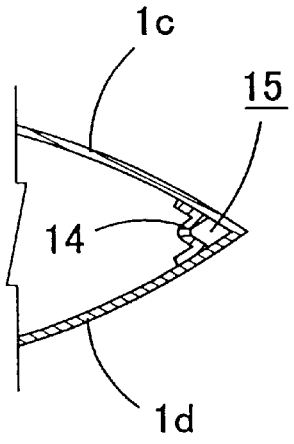
FIG. 6 is a magnified cross section of the principal components of the bathing bag showing another spray washing portion.

FIG. 6 is a magnified cross section of the principal components of the bathing bag having an spray washing portion of another embodiment. As shown in FIG. 6, spray washing portion 13 has a heat seal on both ends of band-shaped synthetic resin inner sheet 14 and on front surface sheet 1*c* and rear surface sheet id of bathing bag 1. Further, the upper portion is closed and the lower portion links to joint portion 3*b* forming a space 15 in the upper/lower directions of the corner inside bathing bag 1 and a plurality of spray holes 13*b* are drilled on the inner sheet 14.

In other words, when hot water is supplied to the inside of spray washing portion 13, water pressure sprays hot water from spray holes 13*b* spraying the body of the bather. Further, at least one spray washing portion 13 is sufficient and at least one spray hole 13*b* is sufficient as well.

Next, shower nozzle 16 will be described.

Figure 7:
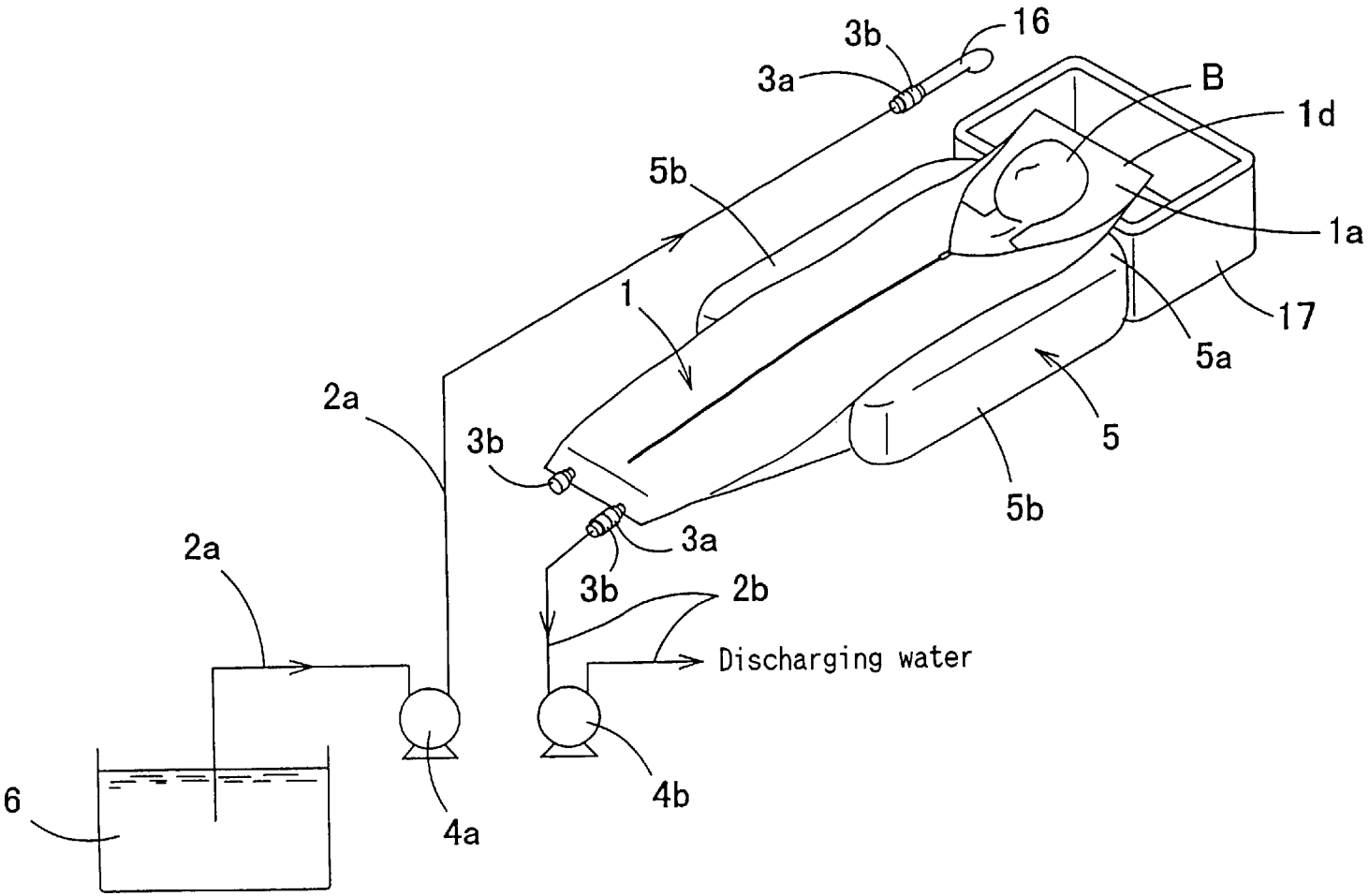
FIG. 7 is an explanatory view showing another usage state of the bathing apparatus.

As shown in FIG. 7, joint portion 3*b* of above-mentioned joint 3 is mounted to the base of shower nozzle 16. Joint portion 3*b* of shower nozzle 16 can be linked to joint portion 3*a* provided on the end of above-mentioned water supply hose 2*a*. Further, joint portion 3*b* can be mounted to the end of above-mentioned water supply hose 2*a* and joint portion 3*a* can be mounted to shower nozzle 16.

When water supply pump 4*a* is operated, hot water inside bathtub 6 is drawn up and sprayed from shower nozzle 16 thereby allowing the hair and body of bather B to be washed. At this time, if hair washing table 17 is provided at the rear of the head of bather B and if rear surface sheet 1*d* of open portion 1*a* of bathing bag 1 is extended in the rearward direction, hair washing can be easily done using shower nozzle 16. Hair washing table 17 provided at the rear of the head of bather B and rear surface sheet 1*d* of bathing bag 1 extending in the rearward direction in order to wash hair comprise the hair washing portion.

Next, a representative bathing operation will be described for a case when one assistant helps a disabled person (such as an elderly person) to enter a bath using bathing apparatus A of the first embodiment. At first, the assistant places bather B into bathing bag 1 in like manner to replacing bedsheets. In other words, after a fastener (open/close portion 1*b*) located on bathing bag 1 is lowered downward, bathing bag 1 opened up and made into a bedsheet shape, and half of bathing bag 1 is rolled up. Naked bather B is then helped to lie on their side on a bed or futon and the portion of the rolled up bathing bag 1 is placed at the back of the bather. Next, bather B helped to lie on their side in a direction opposite to the one mentioned above, the rolled up bathing bag 1 is opened and then bather B is helped to lie on their back. By closing the fastener, bather B is housed inside bathing bag 1. With bather B inside bathing bag 1 in this manner, support body 5 is placed under the head of bather B so bather B fits in back support 5*a* of support body 5. In addition, the body of bather B is positioned between side support bodies 5*b* and 5*b*, the head of bather B is diagonally leaned upward and open portion 1*a* of bathing bag 1 is maintained in a state facing upward. Next, joint portion 3*a* and 3*b* provided on the lower portion of bathing bag 1 are utilized to connect water supply hose 2*a* and water discharge hose 2*b* and form a usable state.

Then, when water supply pump 4*a* of bathing apparatus A is operated, bathing is possible while hot water is supplied from water supply hose 2*a* and hot water is sprayed from spray holes 13*a* of pipe 13*a* of spray washing portion 13 toward the body of bather B. Bathing liquid can be discharged after bathing is complete when water discharge pump 4*b* is operated. Further, by removing water supply hose 2*a* and water discharge hose 2*b* as necessary, a water non-passing state for joints 3*a*, 3*b* provided on bathing bag 1 as well as a water non-passing state for joints 3*b*, 3*a* provided on the ends of water supply hose 2*a* and water discharge hose 2*b* are maintained. This eliminates hot water and bathing liquid from overflowing and soiling the inside of the chamber.

According to this type of bathing apparatus A of the first embodiment, because bathing bag 1 and water supply hose 2*a* as well as bathing bag 1 and water discharge hose 2*b* are linked by joint 3, when joint portion 3*b* is removed from joint portion 3*a*, valve body 9 is maintained in a water non-passing state closing the throughholes by means of the elasticity of elastic material 8 inside joints 3*a*, 3*b* provided on bathing bag 1 and valve body 9 is maintained in a water non-passing state closing the throughholes by means of the elasticity inside joints 3*b*, 3*a* provided on water supply hose 2*a* and water discharge hose 2*b*. Because of this, even if water supply hose 2*a* and water discharge hose 2*b* are removed, water will not leak or overflow from the end of bathing bag 1 or water supply hose 2*a* and water discharge hose 2*b* thereby eliminating and soiling of the inside of the chamber. Further, because water supply hose 2*a* and water discharge hose 2*b* are connected to bathing bag 1 by joint 3, that can be easily detached by a one-touch action.

Even further, because pipe 13*a* having spray holes 13*b* on spray washing portion 13 is disposed such that it is positioned on both sides inside bathing bag 1, when water supply pump 4*a* is operated supplying hot water from water supply hose a, hot water is sprayed for spray holes 13*b* of spray washing portion 13 toward the body of bather B thereby improving the bathing sensation and allowing the body of the bather to be washed.

Even further, because shower nozzle 16 is included whereon joint portion 3*b* of the above-mentioned joint 3 is disposed on the base of the shower nozzle, joint portion 3*b* of shower nozzle 16 can be linked to joint portion 3*a* provided on the end of the above-mentioned water supply hose a. In addition, when water supply pump 4*a* is operated, hot water inside bathtub 6 is drawn up and sprayed from shower nozzle 16 thereby allowing the hair and body of bather B to be washed. At this time, if hair washing table 17 is provided at the rear of the head of bather B and if rear surface sheet 1*d* of bathing bag 1 is extended in the rearward direction forming a hair washing portion, hair washing can be easily done.

Hot water of bathtub 6 is used in bathing apparatus A described above. However, a device that supplies hot water from a water heating apparatus having a hot water storage portion such as an electric water heater or a solar water heater can be used or an instantaneous gas water heater. Moreover, other than hot water, cold water or a bathing liquid wherein a washing agent is mixed with hot water or cold water can be used.

Next, a usage method for suction nozzle 18 after bathing using bathing apparatus A will be described.

Figure 8:
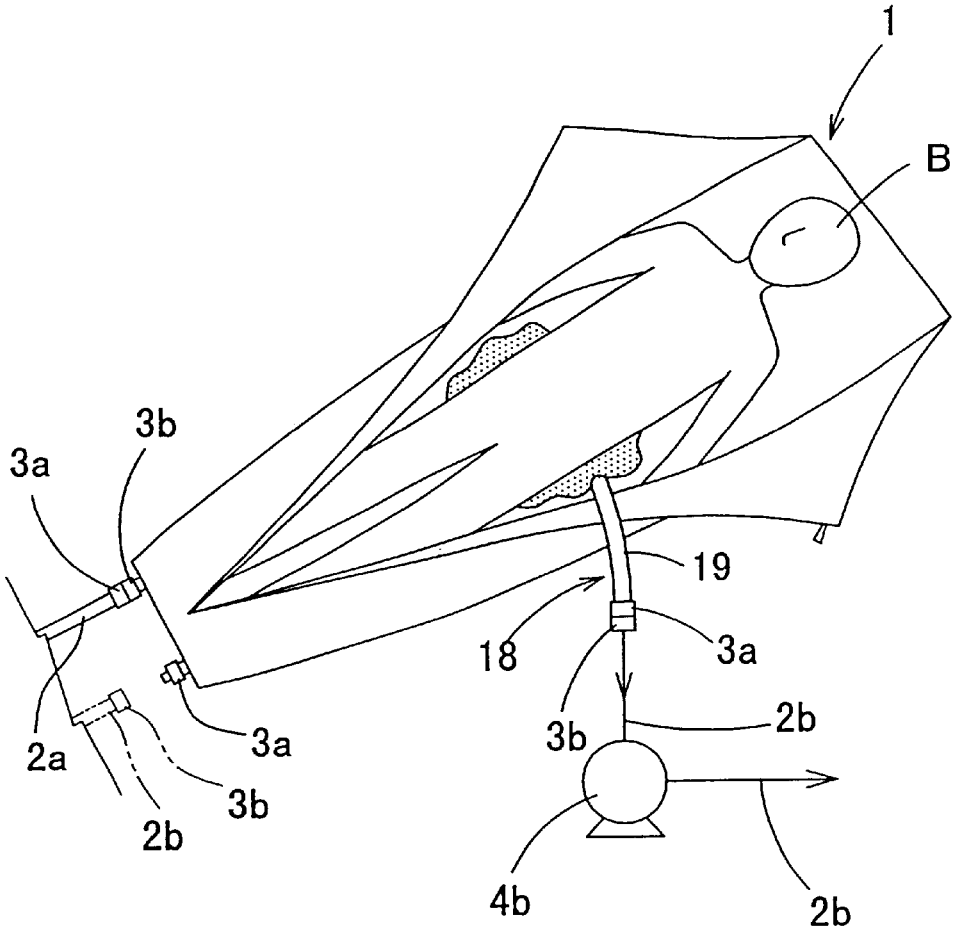
FIG. 8 is an explanatory view showing a usage state after entering the bath of the same bathing apparatus.

As shown in FIG. 8, on suction nozzle 18 joint portion 3*a* or joint portion 3*b* of the above-mentioned joint 3 is mounted to the base of nozzle 19 that has a suction open portion on the end. Joint portion 3*a* or joint portion 3*b* of suction nozzle 18 can be linked to joint portion 3*b* or joint portion 3*a* provided on the end of the above-mentioned water discharge hose 2*b*. When water discharge pump 4*b* is operated, the suction force of water discharge pump 4*b* makes it possible to suck up and remove bathing liquid remaining inside bathing bag 1 from suction nozzle 18. Joint 3 is used for the connection of water discharge hose 2*b* in suction nozzle 18. However, a simple hose inserted into the base of suction nozzle 18 can be used as well. Further, a three-way cock can be attached to water discharge hose 2*b* between water discharge pump 4*b* and bathing bag 1 linking joint portion 3*a* or joint portion 3*b* of suction nozzle 18. Even if bathing bag 1 and the suction open portion are brought into contact with or adhered to the suction open portion of nozzle 19, it is preferable to provide concave portions at fixed intervals in order to allow remaining liquid to be sucked out.

Figure 9:
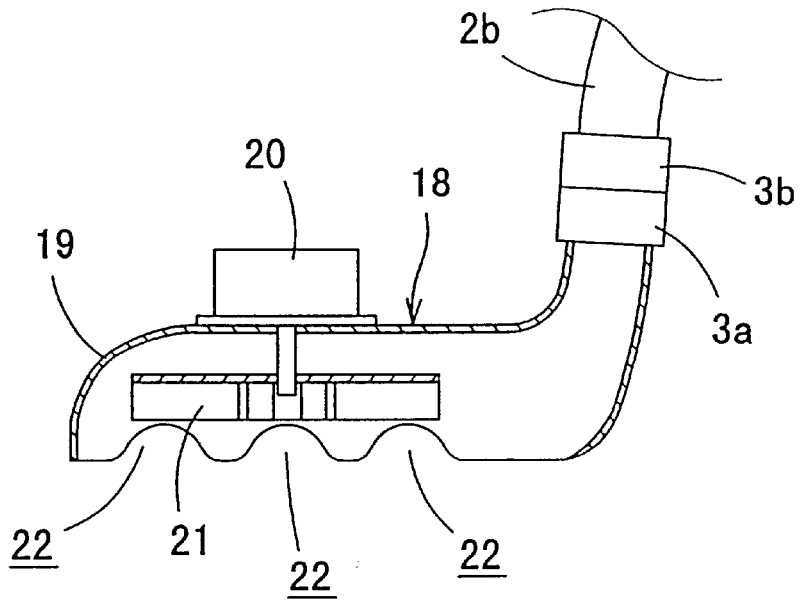
FIG. 9 is an explanatory cross section of another suction nozzle.
Figure 10:
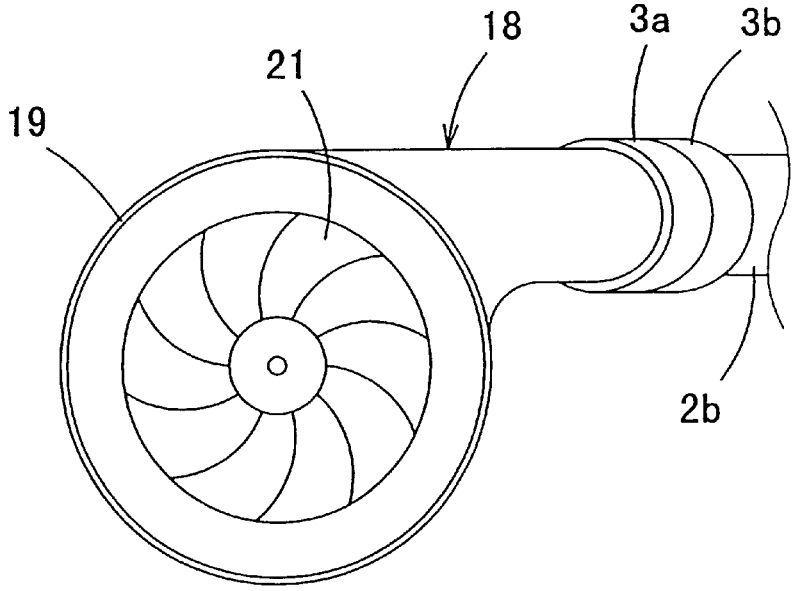
FIG. 10 is a bottom view of the same suction nozzle.

FIG. 9 and FIG. 10 show the end of another suction nozzle. As shown in FIG. 9 and FIG. 10, suction nozzle 18 is provided with impeller 21 rotated by motor 20 on the end of dome-shaped nozzle 19 opened to the lower surface. Bathing liquid remaining inside bathing bag 1 can be sucked out and removed by means of motor 20 rotating impeller 21. Suction nozzle 18 itself functions as a centrifugal pump. Even further, suction nozzle 18 of the example in the figure is provided with concave portions 22 at fixed intervals on the lower end of nozzle 19 in order to make it easy to suck up the bathing liquid.

The suction force of water discharge pump 4*b* along with the suction force generated by the rotation of impeller 21 rotated by motor 20 located on nozzle 19 which occur when using suction nozzle 18 as shown in FIG. 9 and FIG. 10 sucks out bathing liquid remaining inside bathing bag 1 thereby making it possible to completely remove the bathing liquid. Moreover, because concave portions 22 are provided at fixed intervals on the lower end of nozzle 19 of suction nozzle 18, even if the end of nozzle 19 is held against the inner surface of bathing bag 1, bathing liquid can be sucked up and removed through concave portions 22. Even further, if suction nozzle 18 as shown in FIG. 9 and FIG. 10 is used, remaining bathing liquid can be discharged by the rotation of impeller 21 even if water discharge pump 4*b* is not used.

When bathing is complete, water discharge pump 4*b* discharges bathing liquid inside bathing bag 1 from water discharge hose 2*b*. At the time the discharge completes, fastener (open/close portion 1*b*) is lowered downward, bathing bag 1 is opened, joint 3 of water discharge hose 2*b* is removed, joint portion 3*b* on the end of water discharge hose 2*b* is linked to joint portion 3*a* of suction nozzle 18 and water discharge pump 4*b* is operated allowing bathing liquid accumulated around the lower back of bather B to be sucked up from the end of suction nozzle 18 and completely removed. Then, after bather B is removed from bathing bag 1 in like manner to replacing bedsheets, bathing bag 1 is dried and then can be folded and stored.

According to this type of bathing apparatus A of this embodiment, bathing liquid accumulated around the lower back of bather B can be sucked up from the end of suction nozzle 18 water discharge pump 4*b* and completely removed after bathing liquid inside bathing bag 1 discharged. In addition, joint 3 allows suction nozzle 18 to be connected to water discharge hose 2*b* by a one-touch action and even further, because water discharge hose 2*b* that has existing water discharge pump 4*b* can be used, the efficiency is increased as well as being economical. Moreover, because joint portion 3*b* is provided on the base of suction nozzle 18, joint portion 3*b* of suction nozzle 18 enters a water non-passing state with suction nozzle 18 removed from water discharge hose 2*b* without water that has accumulated inside overflowing.

Figure 11:
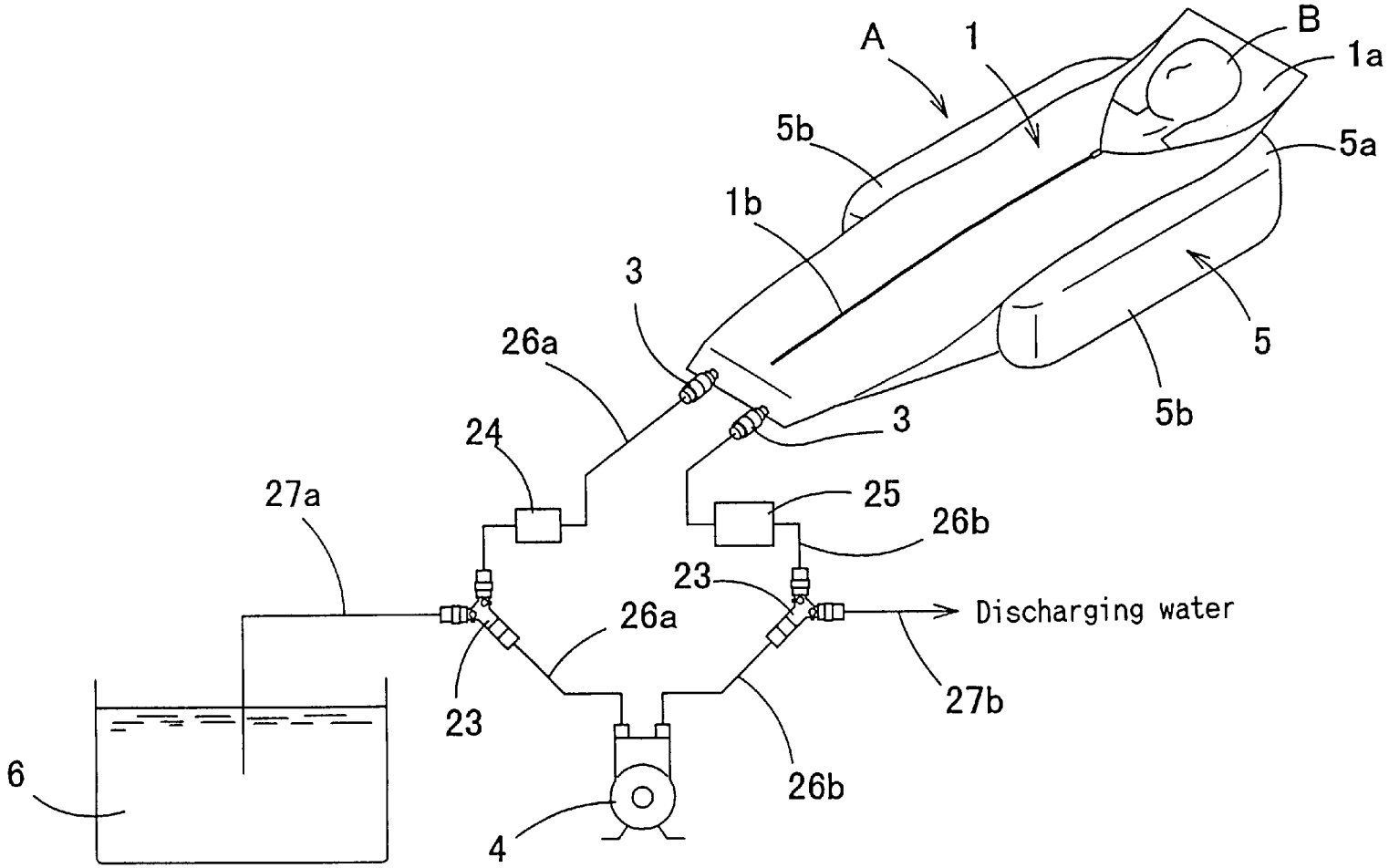
FIG. 11 is an explanatory view showing a usage state of the bathing apparatus of the second embodiment.

FIG. 11 is an explanatory view showing a usage state of the bathing apparatus of the second embodiment. As shown in FIG. 11, bathing apparatus A is comprised by bathing bag 1, pump 4, support body 5, switching valve 23, filter 24 and water processing device 25. These are connected by hose 26 and hot water of bathtub 6 is used for bathing.

As shown in FIG. 11, in bathing apparatus A, the ends of the two hoses connect to the two joints 3, 3 on the lower end of bathing bag 1. Further, the base of both hoses connect to the outlet and inlet of pump 4 forming a closed loop. Pump 4 forms a termination point for suction side hose 26*a* and discharge side hose 26*b*. Further, a three-way valve (switching valve 23) is provided in suction side hose 26*a* and water supply hose 27*a* connects to a branching pipe of this three-way valve. Even further, a three-way valve (switching valve 23) is provided in discharge side hose 26*b* and water discharge hose 27*b* connects to a branching pipe of this three-way valve. In addition, filter 24 is provided between switching valve 23 and joint 3 in suction side hose 26*a* and water processing device 25 is provided between switching valve 23 and joint 3 in discharge side hose 26*b*.

Hereupon, pump 4 uses a self-priming type pump. It is more preferable for the motor that drives pump 4 to be a DC (direct current) type that operates using a low voltage taking into consideration the chance of voltage leakage.

Figure 12:
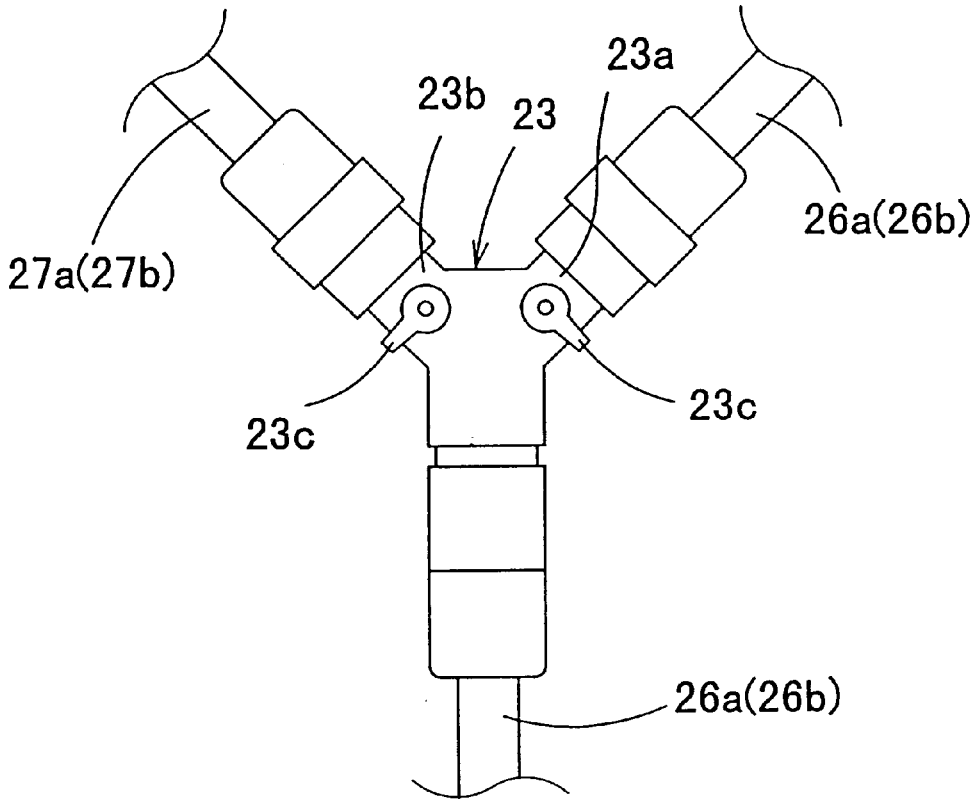
FIG. 12 is a top view showing a switching valve.

As shown in FIG. 12, the three-way valve used as switching valve 23 has an approximate Y-shape and has branching pipe 23*b* disposed opposite main pipe 23*a*. Further, levers 23c are provided that allow the internal valve body in both main pipe 23*a* and branching pipe 23*b* to operate and open and close. By means of the open portion and closing action of these levers, the flow path in main pipe 23*a* and branching pipe 23*b* can be switched. The three-way valve in the example in the figure is a manual type valve although an electromagnetic valve can be used that allows automatic open portion and closing. If a three-way valve is used in switching valve 23 in this manner, the composition of bathing apparatus A and the operation of switching valve 23 are simplified and in particular, if an electromagnetic valve is used, the switching action of switching valve 23 can be handled remotely becoming a very simple one-touch operation. Moreover, although the flow path is switched using one three-way valve in the above-mentioned switching valve 23, it is not limited to this. A plurality of branching pipes can be provided on a hose set in an approximate Y-shape or a manual/electromagnetic valve independent of each branching pipe can be provided.

If an easily detachable joint is used for joint 3 there are no particular limits on the type of joint. However, taking into consideration the removal of joints 3 in a state in which hot water is in bathing bag 1, it is preferable to leave at least one joint in a water non-passing state when not linked.

Water processing device 25 is a device that produces either hot water with reduced amounts of bacteria or functional water. In detail, water processing device 25 includes an ozone producing device, an bacteria reducing device that uses a hollow membrane filter or an ultrasonic device, or a device that produces super oxidized hot water, water with high alkalinity, magnetized water, mineral water, PPP water, water combining a heat-insulating material or water with a washing agent included. By means of providing this water processing device 25 and processing the water, the body of the bather can be washed even more efficiently.

A strainer and a filter can be used in filter 24. This filter functions to remove foreign material generated while bathing making it possible to prevent foreign material from clogging in pump 4 or the hoses and causing damage. In addition, in bathing apparatus A of the example in the figure, filter 24 is provided between switching valve 23 and pump 4 at suction side hose 26*a*. However, the filter can be provided between switching valve 23 and the discharge open portion inside bathing bag 1 or switching valve 23.

Further, in the above-mentioned bathing bag 1, filter 24 and water processing device 25 are provided separately. It is more preferable, however, to have an integrated composition wherein filter 24 and water processing device 25 are combined.

Hot water and the flow of bathing liquid in bathing apparatus A will be described. At first, for a case when supplying hot water to the inside of bathing bag 1 for bathing, when main pipe 23*a* of switching valve 23 on the suction side closes, branching pipe 23*b* opens, main pipe 23*a* of switching valve 23 on the discharge side opens, branching pipe 23*b* closes and pump 4 is operated, as shown in FIG. 13(*a*), hot water of bathtub 6 is sucked up from water supply hose 27*a*, passes through discharge side hose 26*b*, and is then supplied to the inside of bathing bag 1 thereby allowing the supply of water.

Figure 13A:
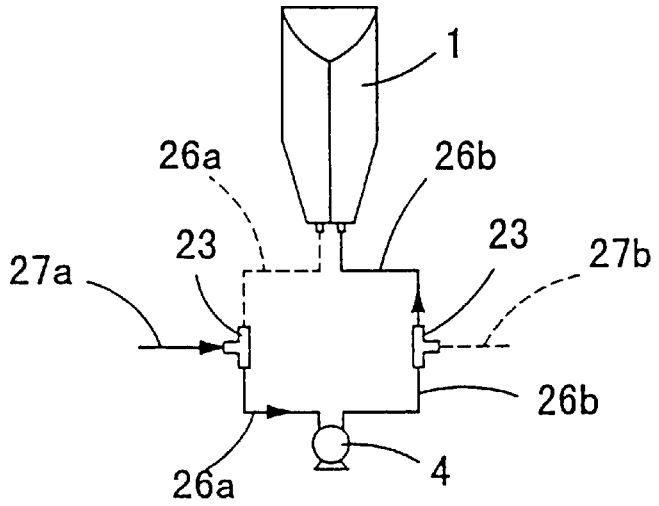
FIG. 13(*a*) is a conceptual view showing water supply of a bathing apparatus.
Figure 13B:
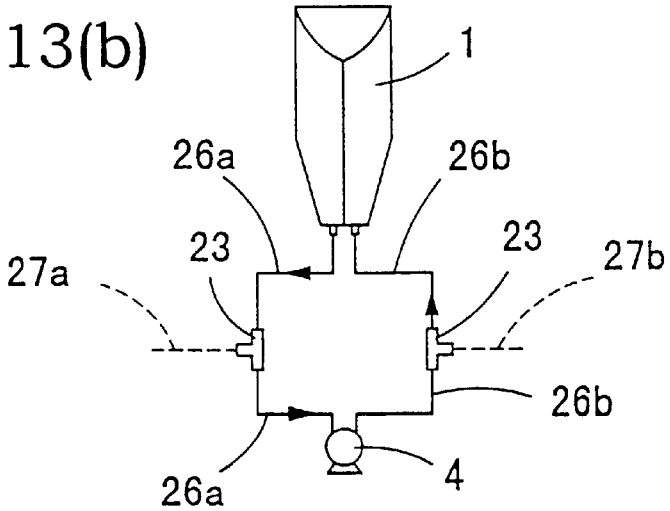
Figure 13C:
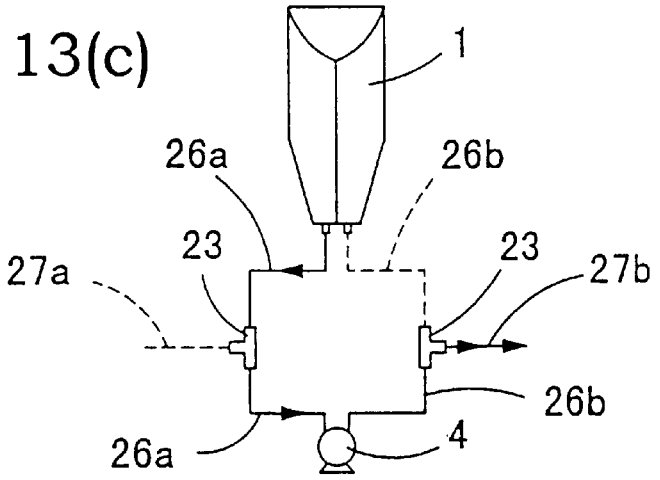

Next, for a case when washing the body of bather B inside bathing bag 1, when main pipe 23*a* of switching valve 23 on the suction side opens, branching pipe 23*b* closes, main pipe 23*a* of switching valve 23 on the discharge side opens, branching pipe 23*b* closes and pump 4 is operated, as shown in FIG. 13(*b*), bathing liquid inside bathing bag 1 is sucked up from suction side hose 26*a*, passes through discharge side hose 26*b*, and is then supplied to the inside of bathing bag 1 thereby allowing the circulation of bathing liquid.

Lastly, for a case when discharging bathing liquid after bathing, when main pipe 23*a* of switching valve 23 on the suction side opens, branching pipe 23*b* closes, main pipe 23*a* of switching valve 23 on the discharge side closes, branching pipe 23*b* opens and pump 4 is operated, as shown in FIG. 13(*c*), bathing liquid inside bathing bag 1 is sucked up from suction side hose 26*a*, passes through discharge side hose 26*b*, and is then discharged to the outside thereby allowing the discharge of bathing liquid. By switching valve 23 on the suction side and switching valve 23 on the discharge side in this manner, it is possible to supply water, circulate bathing liquid and discharge bathing liquid.

Next, as shown in FIG. 13(*a*), when main pipe 23*a* of switching valve 23 on the suction side closes, branching pipe 23*b* opens, main pipe 23*a* of switching valve 23 on the discharge side opens, branching pipe 23*b* closes and pump 4 is operated, hot water of bathtub 6 is sucked up from water supply hose 27*a*, passes through discharge side hose 26*b*, and is then supplied to the inside of bathing bag 1. Then, after supplying a sufficient amount of hot water, as shown in FIG. 13(*b*), when main pipe 23*a* of switching valve 23 on the suction side opens, branching pipe 23*b* closes, main pipe 23*a* of switching valve 23 on the discharge side opens, branching pipe 23*b* closes and pump 4 is operated, bathing liquid inside bathing bag 1 is sucked up from suction side hose 26*a*, passes through discharge side hose 26*b*, and is then supplied to the inside of bathing bag 1. This action circulates the bathing liquid washing the body of bather B inside bathing bag 1. When bathing is complete, as shown in FIG. 13(*c*), when main pipe 23*a* of switching valve 23 on the suction side opens, branching pipe 23*b* closes, main pipe 23*a* of switching valve 23 on the discharge side closes and branching pipe 23*b* opens, bathing liquid inside bathing bag 1 is sucked up from suction side hose 26*a*, passes through discharge side hose 26*b* and water discharge hose 27*b*, and is then discharged to the outside thereby allowing bathing liquid inside bathing bag 1 to be removed.

According to this type of bathing apparatus A of this embodiment, hot water inside a bathtub can be supplied to the inside of bathing bag 1 by pump 4, the body of bather B inside bathing bag 1 can be washed by circulating hot water by pump 4, and then after bathing, bathing liquid inside bathing bag 1 can be discharged by pump 4. Because of these actions, supplying water, circulating bathing liquid and discharging bathing liquid can be simply and economically carried out using only one pump 4 and switching between switching valve 23 on the discharge side and switching valve 23 on the suction side. In particular, by means of using pump 4 to circulate hot water, bathing apparatus A itself can have a washing function and the body of bather B inside bathing bag 1 can be washed without the need for large amounts of hot water. In addition, because water processing device 25 is provided in discharge side hose 26*b*, producing hot water with reduced amounts of bacteria or functional water allows the body of the bather can be washed even more efficiently.

Further, in bathing apparatus A of the second embodiment, because filter 24 is provided in suction side hose 26*a*, foreign material occurring while bathing can be removed preventing foreign material from clogging pump 4 or hoses and damaging the apparatus.

Figure 14:
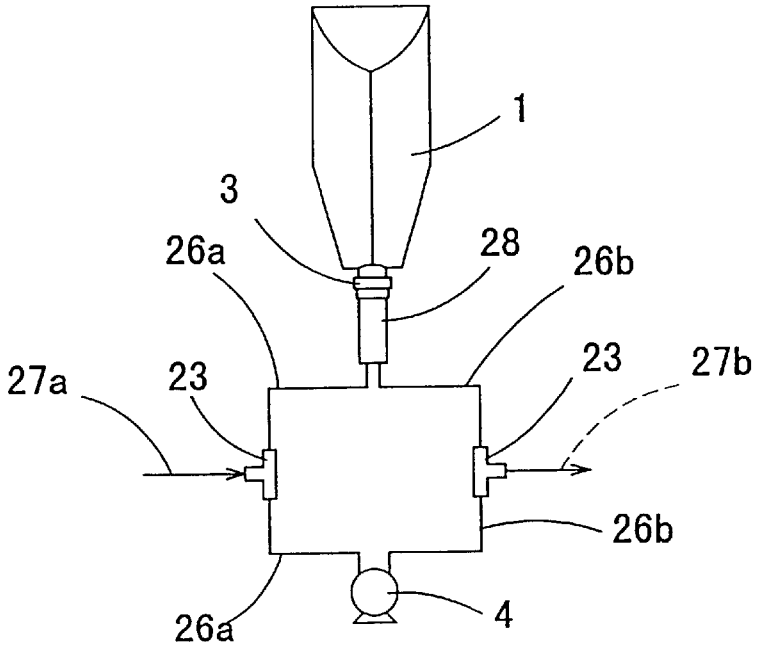
FIG. 14 is an explanatory view showing an example of application of a bathing apparatus.

Even further, in the above-mentioned bathing apparatus A, two joints 3 are provided on the lower end of bathing bag 1 and suction side hose 26*a* and discharge side hose 26*b* are connected to these joints. However, as shown in FIG. 14, suction side hose 26*a* and discharge side hose 26*b* can be connected to one joint 3 and these hoses 26*a*, 26*b* covered and harnessed together up to the front of switching valve 23.

Figure 15:
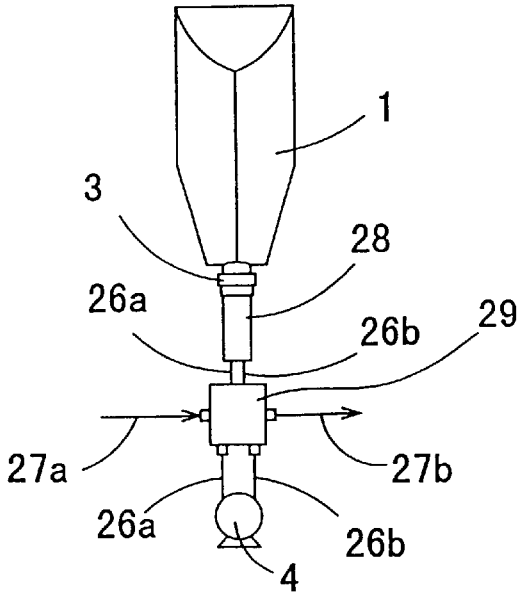
FIG. 15 is an explanatory view showing another example of application of a bathing apparatus.

Even further, in bathing apparatus A shown in FIG. 15, suction side hose 26*a* and discharge side hose 26*b* are harnessed by cover 28 along with two switching valves 23 being arranged in unit 29 and only the combined portion of main pipe 23*a* of switching valve 23 and branching pipe 23*b* protruding outward.

Figure 16:
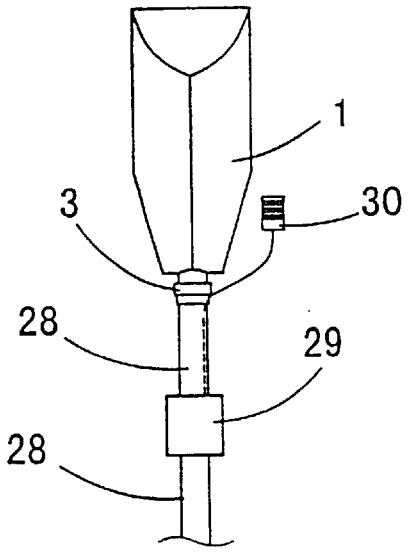
FIG. 16 is an explanatory view showing another example of application of a bathing apparatus.

In bathing apparatus A shown in FIG. 16, switching valve 23 (that uses an electromagnetic valve) and pump 4 are combined in unit 29. Suction side hose 26*a* and discharge side hose 26*b* as well as water supply hose 27*a* and water discharge hose 27*b* are harnessed together by cover 28. When harnessing together suction side hose 26*a* and discharge side hose 26*b*, the electrical wiring of remote control 30 is also positioned inside cover 28. Further, unit 29 (having pump 4) is positioned beside bathtub 6 and remote control 30 that controls pump 4 and switching valve 23 is positioned close to bathing bag 1 to make it easy for bather B to operate the remote control.

Figure 17A:
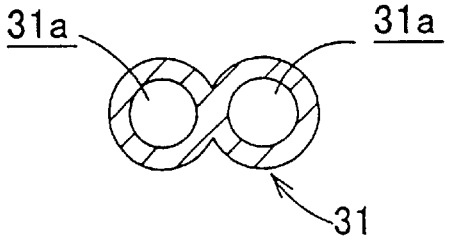
FIG. 17(*a*) is a magnified cross section of another hose.
Figure 17B:
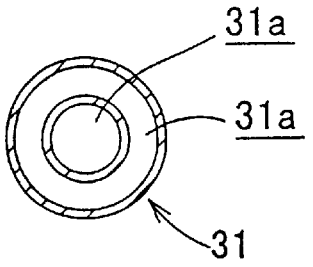

In the example described above, two hoses are used for suction side hose 26*a* and discharge side hose 26*b* and for water supply hose 27*a* and water discharge hose 27*b*. However, as shown in FIG. 17(*a*), hose 31 can be used that has two parallel flow paths 31*a*, 31*a* or as shown in FIG. 17(*b*), hose 30 can be used that has two flow path 31*a*, 31*a* in a double pipe configuration. If this type of hose 31 is used, one hose can be deployed when two hoses would be used. Therefore, the assembly of bathing apparatus A can be handled simply.

Figure 18:
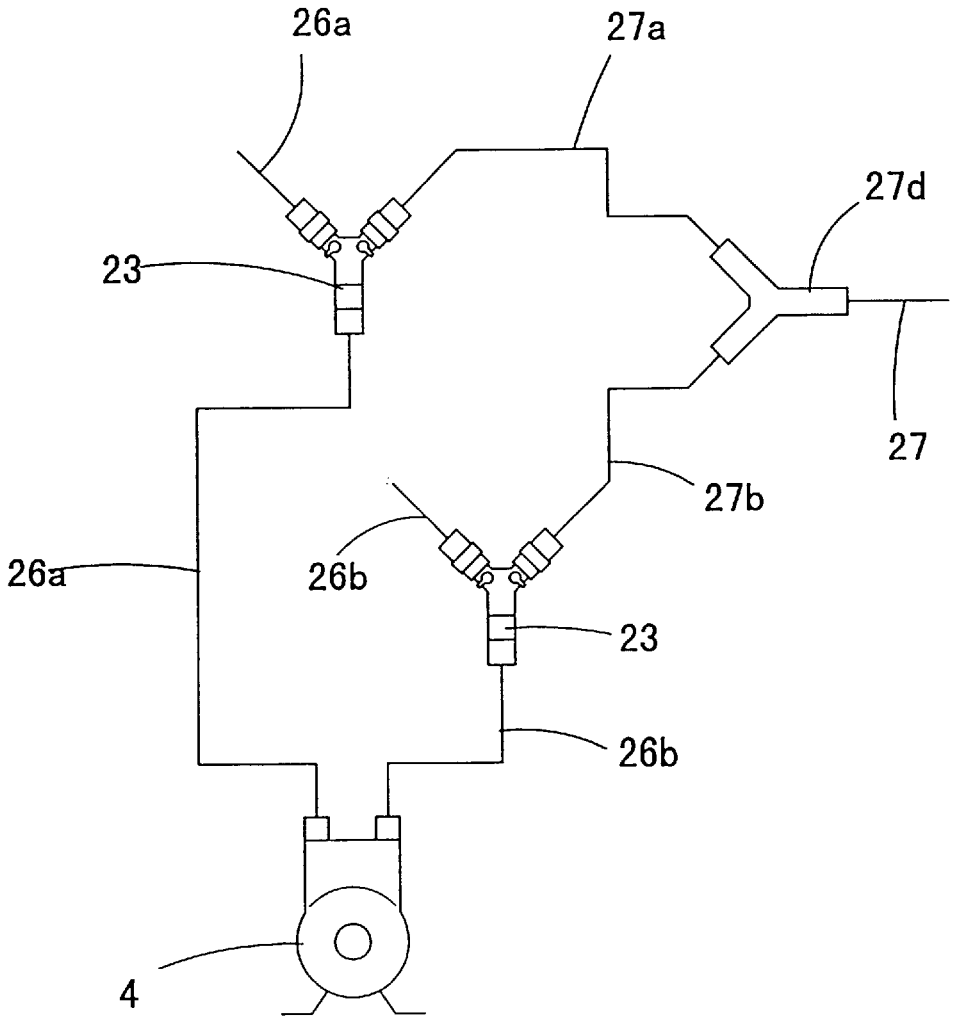
FIG. 18 is an explanatory view showing how a water supply hoe and a water discharge hose are made into one hose.

Furthermore, as shown in FIG. 18, water can be supplied and discharged using one water supply/discharge hose 27 by means of linking water supply hose 27*a* and water discharge hose 27*b*, by three-way coupling 27*d*, switching water supply and water discharge by switching valve 23, inserting the end of water supply/discharge hose 27 into bathtub 6 when supplying water and removing the end of water supply/discharge hose 27 from bathtub 6 when discharging water and placing the hose at a location where water can be supplied and discharged. Because of this operation, assembly and storage are simplified. Hereupon, three-way coupling 27*d* is not limited to any particular device can be a means to link water supply hose 27*a* and water discharge hose 27*b* forming one water supply/discharge hose 27. For example, a three-way coupling such as a Y-shaped pipe, a hose coupled at three locations itself, or a switching valve with a three-way cock can be suitably used. Even further, if a joint is incorporated that allows water supply/discharge hose 27 to detach the linking portion close to water supply/discharge hose 27, assembly and storage are simplified even more.

Moreover, in the example described above, bathing liquid is supplied from the lower portion of bathing bag 1 along with being discharged and circulated inside bathing bag 1. However, if the sensation of warmth and cleanliness on the body is taken into consideration, bathing liquid can be supplied from open portion 1*a* provided on the upper portion of bathing bag 1, the bathing liquid then being discharged from the lower portion of bathing bag 1 and circulated inside bathing bag 1. Even further, circulating the bathing liquid of bathing bag 1 is not particularly necessary. The bathing liquid can simply be supplied to the inside of bathing bag 1 for a sufficient effect on bather B.

Next, bathing bag 1 and support body 5 used in bathing apparatus A will be described in detail.

Figure 19:
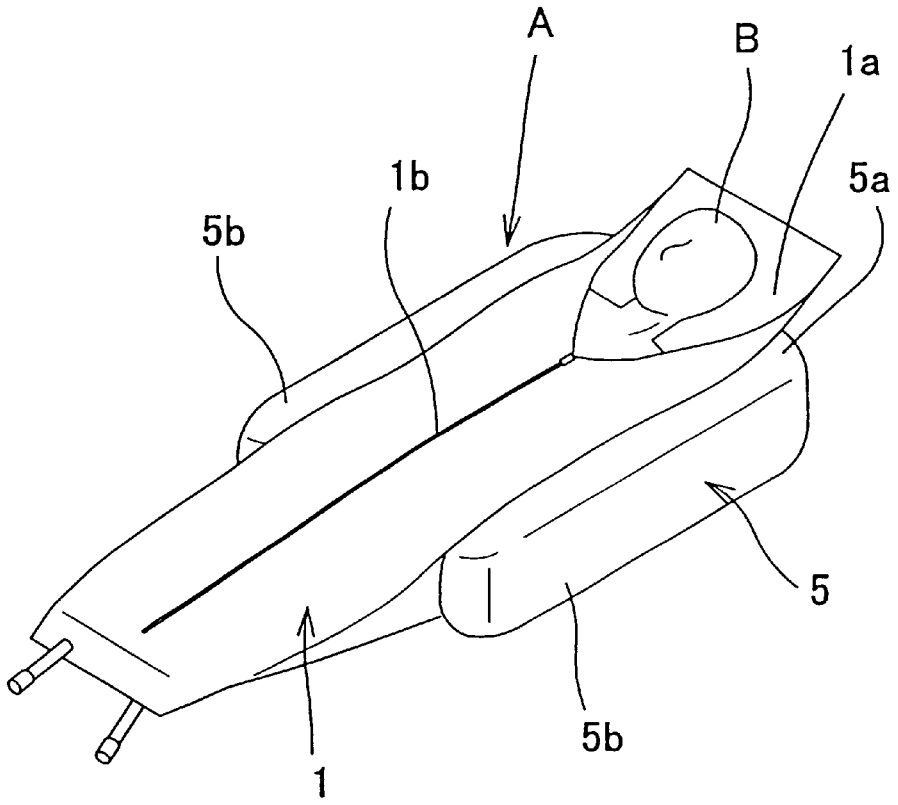
FIG. 19 is a perspective view showing a usage state of the supports of the first embodiment.
Figure 20:
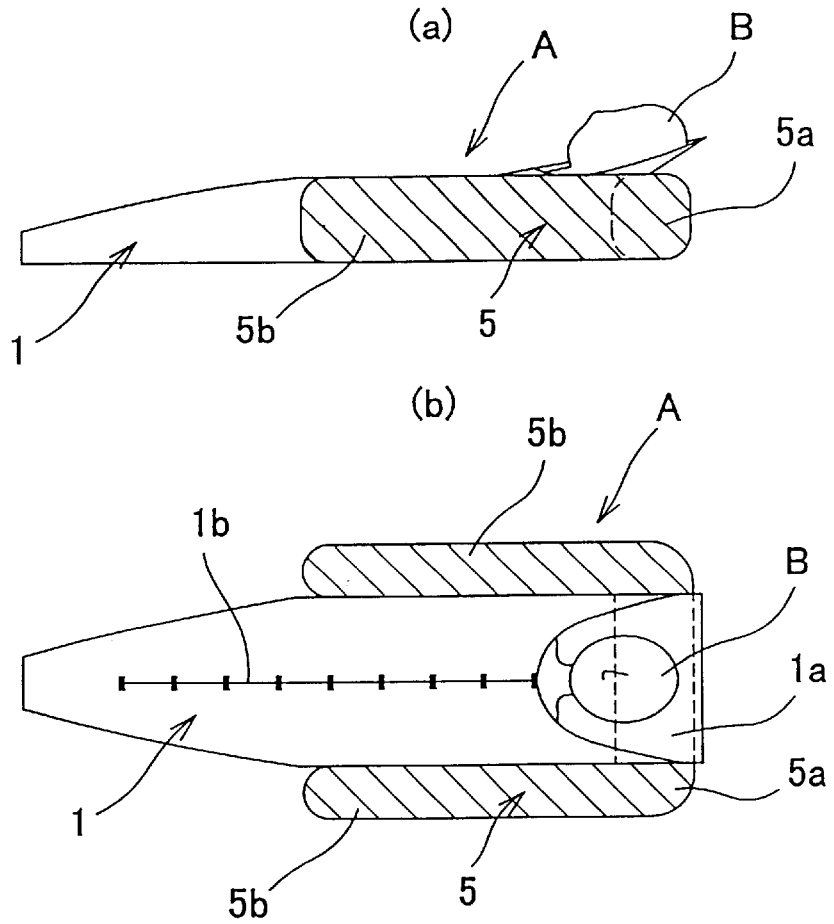
FIG. 20(*a*) is a side view showing a usage state of the supports of the first embodiment.

FIG. 19 and FIG. 20 show the support body of the first embodiment.

As shown in FIG. 19, bathing bag 1 is a bag body comprising a front surface sheet and a rear surface sheet and is formed by overlapping a pair of synthetic resin sheets wherein trapezoid sheet that extends narrowing toward the end from one side of a rectangular sheet (in a plane view) leaving behind the upper border and attaching or thermally fusing the outer edges of both sheets or using both of these methods to form a seal portion. A supply pipe and a discharge pipe are provided on the end portion of this bag body. The material of the seal can be a material having strength to withstand water pressure of the bathing liquid while bathing and an be a cloth processed to be waterproof using a resin such as rubber or elastomer used in a tent material. In particular, a composite sheet that is comprised by a synthetic resin sheet that has excellent pliability and comprises a polyolefin such as vinyl chloride or polypropylene and is reinforced by fiber such as PET or nylon has excellent strength when using bathing liquid, good processability and a comparatively low price thereby making it suitable for the bathing bag material. In detail, the materials for this composite sheet include composite sheets laminated with a vinyl chloride sheet/PET mesh/vinyl chloride sheet or tarpaulin.

Further, it is more preferable to carry out a water repellant process such as bacteria resistant processing or fluorine processing on the front surface sheet and the rear surface sheet. Even further, in order to improve the cushioning, a process such similar to an embossing process can be carried out.

If a watertight state is maintained, various methods can be used for the sealing method. However, a method that uses an adhesive agent, a method that uses water resistant double-sided tape and thermal fusing utilizing high-frequency heating through the sheet material have been considered. Moreover, the adhesive strength can be improved by further sewing on a seal portion. Even further, in bathing bag 1 described above, the bag body is produced by overlapping and sealing two sheets. However, a bathing bag can be used that is created from one sheet or a bag-shaped sheet.

If the open/close portion 1*b* has strength to withstand water pressure of the bathing liquid and maintains a watertight state, various types of fasteners can be used. In order to satisfy this requirement, fasteners can be used which are used in, for example, wet suits or dry suits.

If the shape of open portion 1*a* of bathing bag 1 is a shape that allows a watertight seal at the neck of bather B, bathing liquid will not overflow.

Even further, by means of setting the position that open/close portion 1*b* occupies along one side border on the peripheral border of the bathing bag and in the lengthwise direction of the rear surface sheet, the entire bathing bag 1 can have a composition that allows it to open in a sheet shape. Or, by means of providing open/close portion 1*b* on the entire peripheral border of the bathing bag, a composition can be obtained that allows the entire front surface sheet and rear surface sheet to be completely separated. Even further, by means of successively providing open/close portion 1*b* in the lengthwise direction at the approximate center portion of the front surface sheet and the rear surface sheet of the bathing bag, a composition can be obtained that allows the bathing bag to be separated at the left and right.

Next, as shown in FIG. 20(*a*) and FIG. 20(*b*), if the length of side support body 5*b* on the side of support body 5 reaches the chest of bather B, that is sufficient although if it reaches the waist of bather B, it is suitable without bathing bag 1 applying pressure to the upper body portion of bather B. Even further, side support body 5*b* can extend to the leg portion or both ends of side support body 5*b* being connected linking in a ring shape.

Moreover, if the height of side support body 5*b* reaches up to the chest of bather B (lying down), it can be practically used. Even further, since water splashing can be prevented if the area of side support body 5*b* around the head area of bather B and the portion of back support 5*a* above the head of bather B are as high or higher than the head of bather B, this is preferable.

Support body 5 of the example in the figure forms a bag body using a sheet reinforced by glass or polyethylene terephtharate fibers including synthetic resin sheets such as vinyl chloride, polyethylene, polyethylene terephtharate, polypropylene or a material combining these into an one integrated body of back support 5*a* and dual side support bodies 5*b*, 5*b*. Air is sealed inside the support body to create to air bag.

When using support body 5, the support body inflated with air is set on the floor surface. Bathing bag 1 can then be loaded into the support body with a bather inside and support body 5 pressed against the back portion of bather B. However, inflating support body 5 with air will make the operation easier than inflating it with air after positioning bathing bag 1 with bather B inside on support body 5 before inflating it with air.

Moreover, although support body 5 described above is a hollow air bag, it can be formed as an integrated solid body using a foam synthetic resin, filled with a cotton material or using a synthetic resin or a type of metal.

In the example described above, bathing bag 1 and support body 5 are comprised by separate members. However, support body 5 can be secured to the lower surface of bathing bag 1 using an adhesive agent or fused by thermal fusing or bathing bag 1 can be integrated into one body. If the shape of open portion 1*a* of bathing bag 1 is an approximate circle that allows the neck of bather B to be held tightly such that no bathing liquid overflows, back support 5*a* is not necessary.

Figure 21:
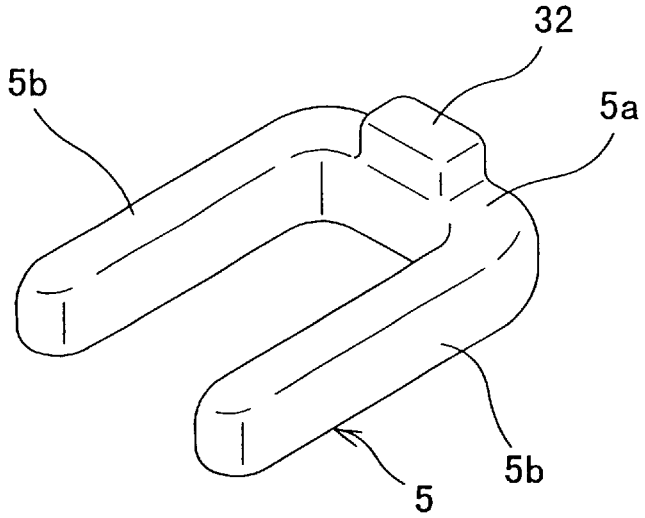
FIG. 21 is a perspective view showing the supports of the second embodiment.

FIG. 21 is a perspective view of the support body of the second embodiment. Support body 5 forms back support 5*a* and side support bodies 5*b*, 5*b* using an airbag and is provided with a pillow portion 32 on the upper surface of back support 5*a*. By means of adding this pillow portion 32, the head of bather B can be made higher thereby maintaining the head of bather B in a state leaning upward diagonally.

Figure 22:
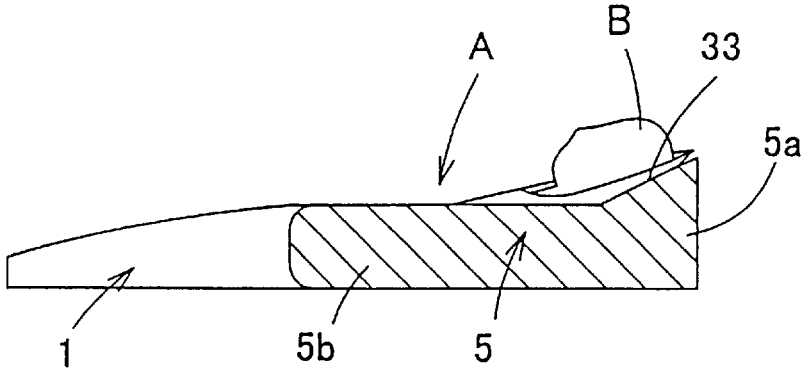
FIG. 22 is a side view showing a usage state of the supports of the third embodiment.

FIG. 22 shows the support body of the third embodiment. Support body 5 forms back support 5*a* and side support bodies 5*b*, 5*b* using an airbag and is provided with a supported inclined surface 33 that leans the upper surface of back support 5*a* upward diagonally facing the rear. By means of providing supported inclined surface 33 on back support 5*a* in this manner, the head of bather B is maintained in a state leaning upward diagonally.

According to bathing apparatus A as shown in FIG. 21 and FIG. 22, by only positioning bather B (enclosed in bathing bag 1) on support body 5, the head of bather B is placed on back support 5*a* and even further, because positioning the body of bather B between one side support body 5*b* and the other side support body 5*b* will lean the head of bather B upward diagonally, open portion 1*a* of bathing bag 1 is in a state facing upward and even if bather B moves slightly, the bathing bag can be used without bathing liquid inside bathing bag 1 overflowing. In particular, because the body of bather B is positioned between one side support body 5*b* and the other side support body 5*b* of support body 5, bathing bag 1 is prevented from enlarging in the lengthwise direction which maintains its shape and allows comfortable bathing without sealing the body of bather B in bathing bag 1. Even further, if support body 5 is formed by an air bag, it will have excellent cushioning and in particular, if the distance between one side support body 5*b* and the other side support body 5*b* is set to a dimensional relationship that allows bather B to be sealed and held in bathing bag B, bather B (enclosed in bathing bag 1) can be reliably secured without slippage during use.

In addition, because bathing apparatus A is comprised by only bathing bag 1 and support body 5 with bathing bag 1 (functioning as the principal role in the apparatus) only having a pair of overlapping sheets with the upper border being left to seal the outer border (edge), the construction is simple allowing a compact, low-cost apparatus to be obtained.

Moreover, in order to improve the bathing effect, it is possible to insert the ends of the nozzles from suitable locations on both sides of bathing bag 1 and then direct bathing liquid or bathing liquid mixed with washing agent onto the body of bather B inside bathing bag 1. And in addition, it is possible to insert a plurality of througholes provided with pipes into the inside of bathing bag 1 and the direct hot water or hot water mixed with washing agent onto the body of bather B inside bathing bag 1.

The principal purpose of bathing apparatus A is bathing of disabled persons. However, naturally healthy people can also use the apparatus for bathing in a bath or similar. Even further, the entire bathing bag 1 or one portion can be made clear or incorporate a device that allows pressure to be applied to one portion of the body of bather B. For example, it can be used for ??beauty clinic?? use.

Figure 23A:
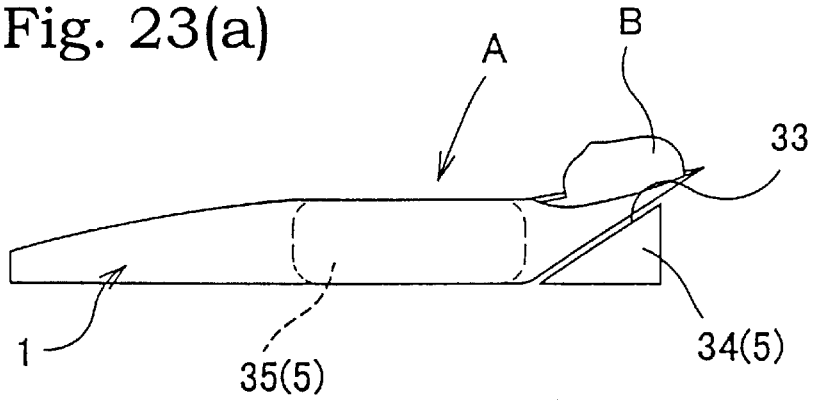
FIG. 23(*a*) is a side view showing a usage state of the supports of the fourth embodiment.
Figure 23B:
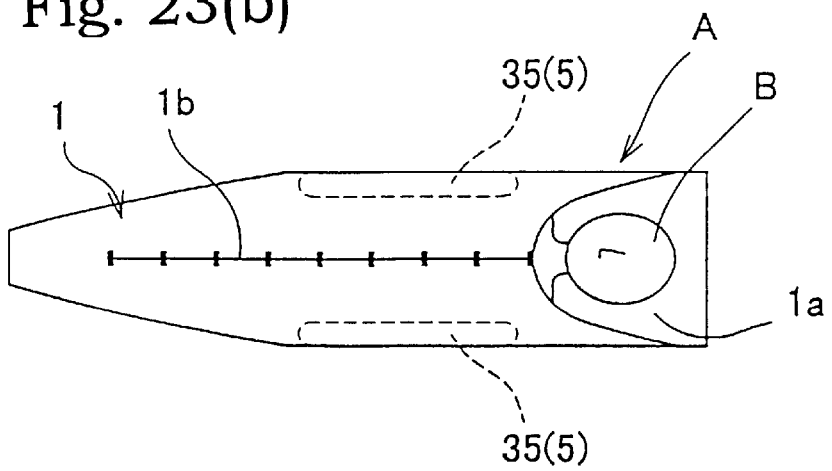

FIG. 23 is a top view shows the support body of the fourth embodiment.

As shown in FIG. 23(*a*) and FIG. 23(*b*), support body 5 is comprised by back support 34 and a pair of side support bodies 35, 35.

Back support 34 has supported inclined surface 33 that is leaned upward diagonally facing the rear.

Side support body 35 is a panel-shaped member that positioned at the side of bather B inside bathing bag 1. The size of side support body 35 is set such that the height is almost equal to the thickness of the chest of bather B and the length extends from the shoulders to the waist of bather B. By means of installing the pair of side support bodies 35, 35 positioned on both sides inside bathing bag 1 in this manner, the shape of bathing bag 1 can be maintained without bathing liquid inside bathing bag 1 overflowing.

Side support body 35 is mounted such that it is positioned on both sides of bather 3 inside bathing bag 1. However, it can be positioned inside bathing bag 1 and then secured using an adhesive agent, fused or by using pins. And in addition, a dividing sheet can be provided inside bathing bag 1, a storage portion formed inside and then side support body 35 stored and secured inside this storage portion, even further, as methods to secure side support body 35, a belt can be wound and secured or secured using a surface fastener.

A synthetic resin, wood material, or metal can be utilized for the material of back support 34 and side support body 35. In particular, if back support 34 and side support body 35 are formed from a foam synthetic resin such as polystyrene or polypropylene, the lightweight makes it easy to handle and as well as being convenient. Moreover, metal or vinyl chloride pipes can be fabricated in the frame body to form side support body 35 or the bag body can be formed using a synthetic resin sheet such as vinyl chloride to form an air bag inflated with air.

Furthermore, in support body 5 described above, although back support 34 and side support body 35 are comprised by a member separate from bathing bag 1, they can be formed as an integrated body.

According to this type of support body 5 of the fourth embodiment, because the head of bather B can be made higher thereby maintaining the head of bather B in a state leaning upward diagonally by only making back support 34 a pillow and laying bather B (enclosed in bathing bag 1) on their back and side support body 35 are installed inside bathing bag 1 on both sides, the shape of bathing bag 1 can be maintained and open portion 1*a* of bathing bag 1 is in a state facing upward and even if bather B moves slightly, the bathing bag can be used without bathing liquid inside bathing bag 1 overflowing. In particular, because the body of bather B is positioned between side support body 35 of support body 5, bathing bag 1 is prevented from enlarging in the lengthwise direction which maintains its shape and allows comfortable bathing without sealing the body of bather B in bathing bag 1 as well as allowing comfortable bathing. Even further, because side support body 35 is installed inside bathing bag 1, bather B is gripped from both sides thereby allowing bather B (enclosed in bathing bag 1) to be reliably secured without slippage during use.

Figure 24A:
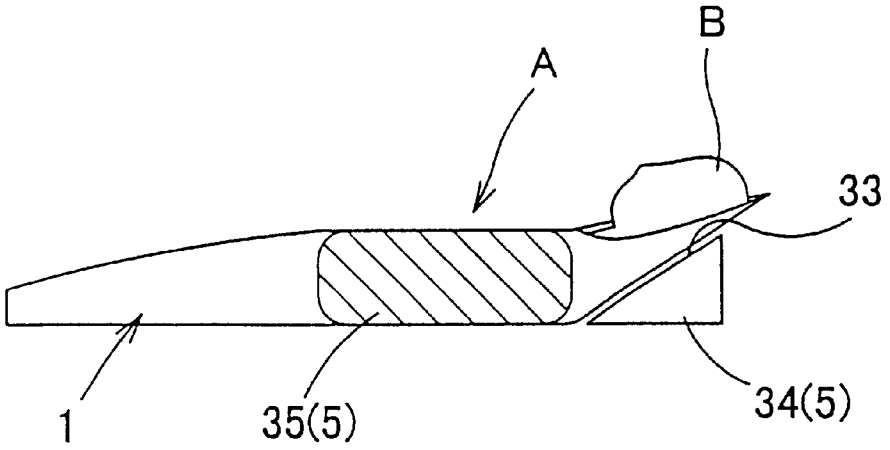
FIG. 24(*a*) is a side view showing a usage state of the supports of the fifth embodiment.
Figure 24B:
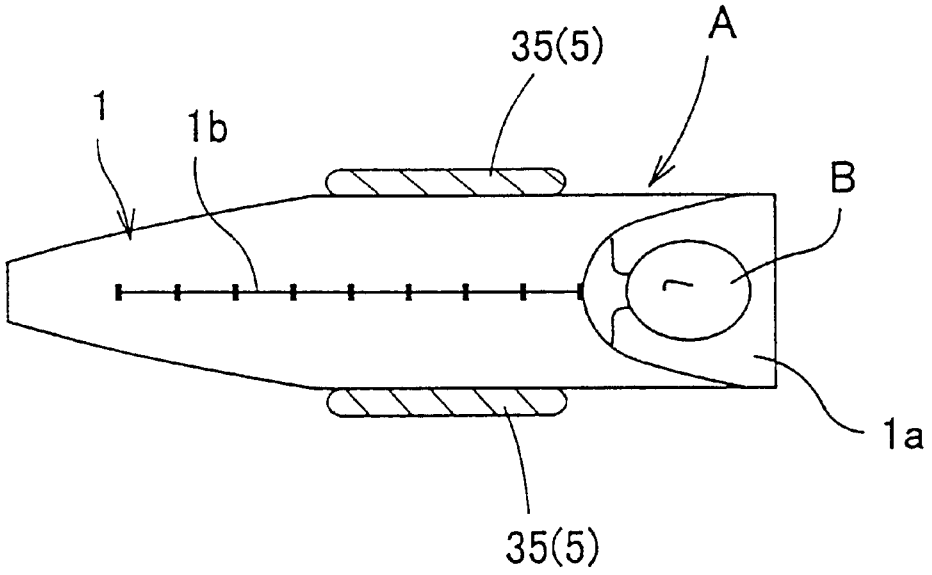

FIG. 24 shows the support body of the fifth embodiment.

In like manner to support body 5 in FIG. 23, support body 5 is comprised by back support 34 and a pair of side support bodies 35, 35 and as shown in FIG. 24(*a*) and FIG. 24(*b*), side support body 35 is disposed in the outside of bathing bag 1. In addition, in like manner to the mounting method of side support body 35, it can be positioned outside bathing bag 1 and then secured using an adhesive agent, fused or by using pins. Furthermore, a dividing sheet can be provided outside bathing bag 1, forming a storage portion formed and then side support body 35 stored and secured inside this storage portion.

Side support body 35 can have an L-shape comprising an upper half and a lower half with the lower half of side support body 35 positioned on the lower surface of bather B (enclosed in bathing bag 1) and side support body 35 disposed on both sides of bather B. Or, the upper portion or the lower portion or the upper portion and the lower portion of side support bodies 35, 35 positioned on both sides of bather B can be linked by sheets and belts or by pipes and side support body 35 secured at fixed intervals.

According to bathing apparatus A as shown in FIG. 23 and FIG. 24, if back support 34 (support body 5) and the pair of side support bodies 35, 35 are secured to bathing bag 1 using adhesive, the production of the apparatus can be made easier.

Figure 25:
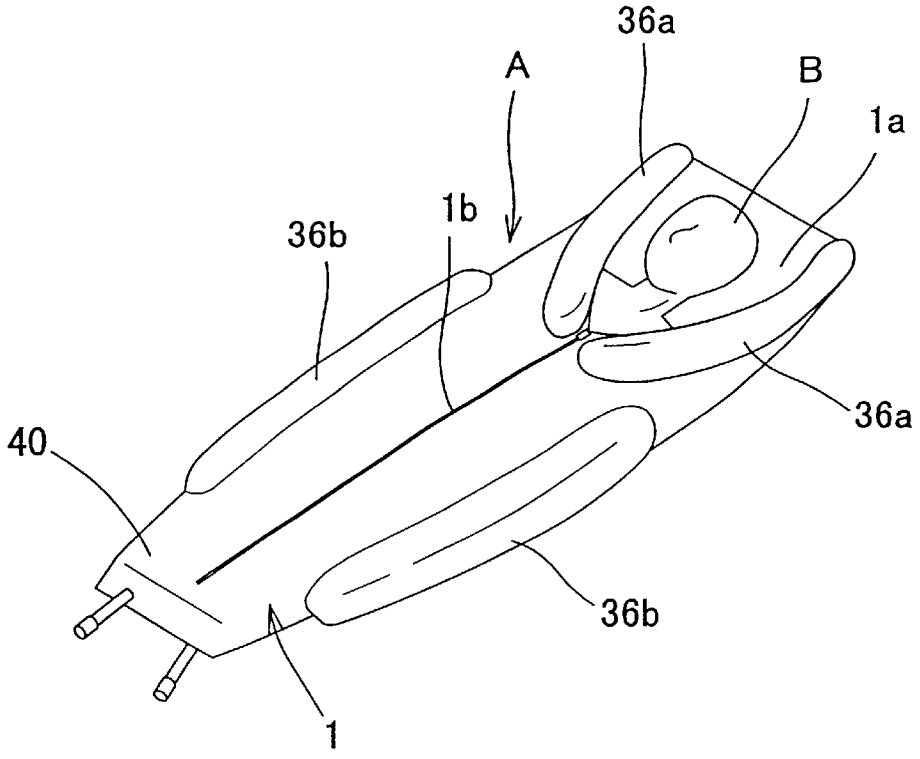
FIG. 25 is a perspective view showing the supports of the sixth embodiment.

FIG. 25 shows the support body of the sixth embodiment.

As shown in FIG. 25, in support body 5, open portion retention portions 36*a* are provided on the left and right sides bordering open/close portion 1*b* along open portion 1*a* on surface sheet 40 of bathing bag 1 and is also provided with side support portions 36*b* on both sides of bathing bag 1.

Support body 5 of the example in the figure forms open portion retention portions 36*a* and side support portions 36*b* using an air bag and is provided as an integrated body on bathing bag 1. According to bathing apparatus A of this embodiment, in addition to the effect of preventing expansion in the lengthwise direction due to side support portions 36*b*, 36*b*, open portion retention portions 36*a* are located higher than open portion 1*a* by means of providing open portion retention portions 36*a* on the periphery of open portion 1*a* thereby making it possible to prevent overflow of bathing liquid from open portion 1*a*.

Figure 26:
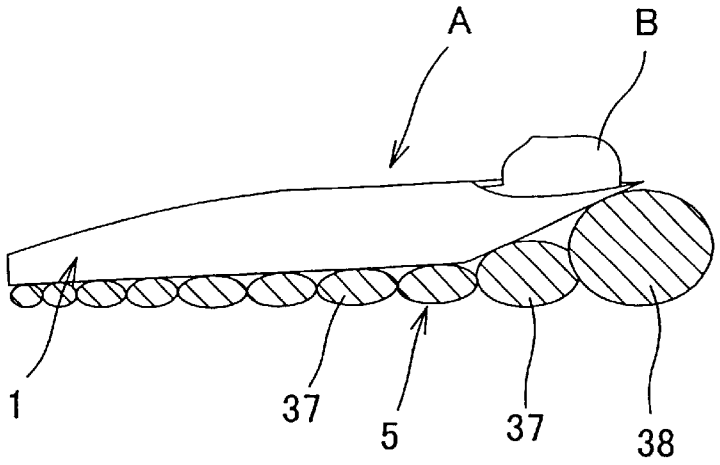
FIG. 26 is a side view showing a usage state of the supports of the seventh embodiment.

FIG. 26 shows the supports of the seventh embodiment.

As shown in FIG. 26, support body 5 uses a sheet-shaped air bag (air mat) that has air chambers 37 at fixed width. The size of air chambers 37 is set to gradually become smaller along the legs from the head portion of bather B. In particular, pillow portion 38 is formed at the portion supporting the head portion of bather B and then by bather B (enclosed in bathing bag 1) being laid down on their back, bathing bag 1 is maintained in a state leaning upward diagonally facing the head portion of bather B.

Because the head of bather B is placed in a state leaning upward diagonally by only placing the head on pillow portion 38 and laying the bather on their back on support body 5 (this air mat), open portion 1*a* of bathing bag 1 is facing upward and even if bather B moves slightly, the bathing bag can be used without bathing liquid inside bathing bag 1 overflowing. This air mat can be formed using a synthetic resin sheet such as vinyl chloride, polyethylene, polyethylene terephthalate, or polypropylene.

Figure 27:
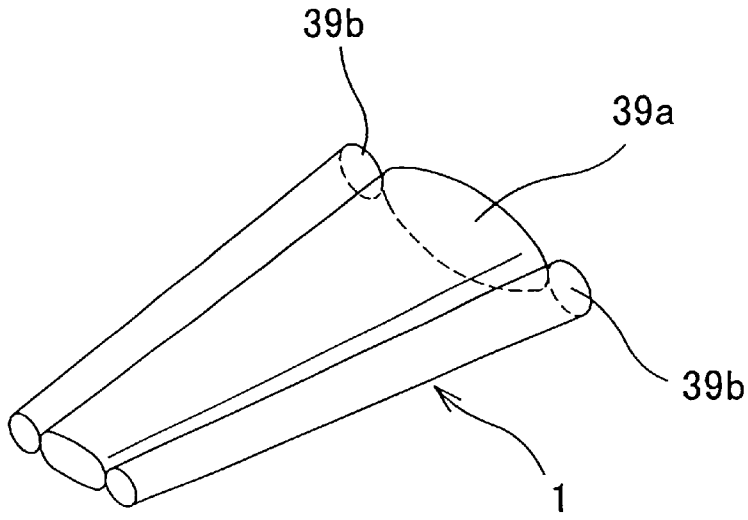
FIG. 27 is a perspective view showing the supports of the eighth embodiment.
Figure 28:
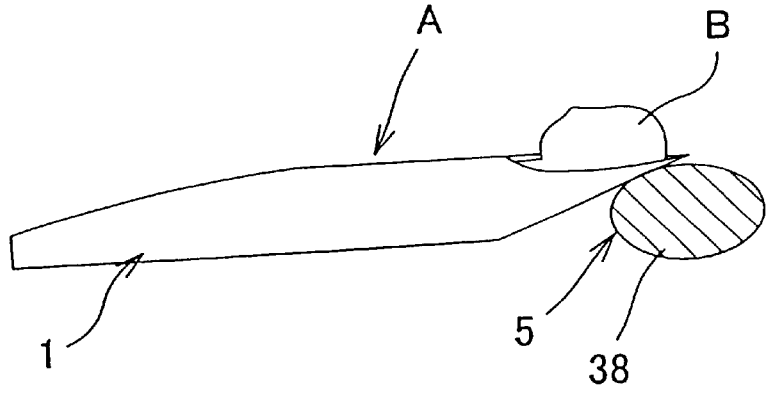
FIG. 28 is a side view showing a usage state of the supports of the ninth embodiment.

Support body 5 of the eighth embodiment shown in FIG. 27 is a modified example of the air mat of FIG. 28. This support body has a long, thin trapezoid shape set so the head portion of bather B becomes wider and is formed by three members comprising long, thin center portion air bag 39*a* and long, thin side air bags 39*b* on both sides. When air is sprayed inside, support body 5 is designed such that each location supporting the head portion increases in height.

FIG. 28 shows the supports of the ninth embodiment.

As shown in FIG. 28, support body 5 is inside a air mat (support body 5 of FIG. 26) and in particular only uses pillow portion 38.

What is claimed is:

1. A bathing apparatus comprising:

an open portion in a bathing bag having a content volume that allows a bather to enter;

the bathing bag provided with open/close portions in succession from the edge of said open portion which can maintain a water tight state when the open/close portions are closed;

a pump;

two hoses connecting by ends thereof to suitable locations of said bathing bag and the opposite ends of these hoses connecting to an outlet of said pump thereby forming a suction side hose and a discharge side hose, a first switching valve in the flow path of the suction side hose that branches a water supply hose that functions to supply bathing liquid to said suction side hose; and a second switching valve in the flow path of the discharge side hose is also provided that branches a water discharge hose that functions to discharge bathing liquid from said discharge side hose.

2. A bathing apparatus as set forth in claim 1 wherein a three-way valve is used as said switching valve.

3. A bathing apparatus as set forth in claim 1, or claim 2 wherein said pump is a self-priming type.

4. A bathing apparatus as set forth in claim 1, or claim 2 provided with a filter within said suction side hose or on a water discharge outlet inside said bathing bag.

5. A bathing apparatus as set forth in claim 1, or claim 2 or claim 4 having a water processing device that either reduces bacteria of the bathing liquid supplied to the inside of said bathing bag or converts the bathing liquid to functional water.

6. A bathing apparatus as set forth in claim 1 or claim 2 wherein said switching valve is an electromagnetic valve.

7. A bathing apparatus as set forth in claim 1, claim 2, claim 3, claim 4, claim 5 or claim 6 that uses hoses having two flow paths as the connected hoses.

8. A bathing apparatus as set forth in claim 1, claim 2, claim 3, claim 4, claim 5, claim 6 or claim 7 wherein said water supply hose and said water discharge hose are linked by a three-way coupling.

* * * * *